US009482459B2

(12) United States Patent
Park et al.

(10) Patent No.: US 9,482,459 B2
(45) Date of Patent: Nov. 1, 2016

(54) REFRIGERATOR WITH SEALED STATE MAINTAINING DEVICE FOR DRAWER

(71) Applicant: LG Electronics Inc., Seoul (KR)

(72) Inventors: Kyongbae Park, Seoul (KR); Ahreum Park, Seoul (KR); Deulre Min, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 559 days.

(21) Appl. No.: 13/924,043

(22) Filed: Jun. 21, 2013

(65) Prior Publication Data

US 2013/0340465 A1 Dec. 26, 2013

(30) Foreign Application Priority Data

Jun. 22, 2012 (KR) ..... 10-2012-0067585
Jul. 17, 2012 (KR) ..... 10-2012-0077930

(51) Int. Cl.
*F25D 17/06* (2006.01)
*F25D 11/00* (2006.01)
*F25D 23/00* (2006.01)
(Continued)

(52) U.S. Cl.
CPC ..... *F25D 11/00* (2013.01); *E05B 5/006* (2013.01); *E05B 17/0025* (2013.01); *E05B 65/0042* (2013.01); *E05B 65/46* (2013.01); *E05C 3/006* (2013.01); *E05C 3/048* (2013.01); *E05C 3/08* (2013.01); *F25D 23/00* (2013.01); *F25D 23/025* (2013.01); *F25D 23/087* (2013.01); *F25D 25/025* (2013.01); *F25D 17/042* (2013.01); *F25D 2317/043* (2013.01); *F25D 2317/0416* (2013.01)

(58) Field of Classification Search
CPC ..... E05C 3/08; E05C 3/048; E05B 17/0025; E05B 65/0042; E05B 65/46; E05B 5/006; F25D 25/025; F25D 23/025; F25D 23/087; F25D 23/00; F25D 17/042; F25D 2317/043; F25D 23/06; F25D 11/00; F25D 2317/0416; B65D 77/0453; B65D 77/0446; B65D 77/04
USPC ..... 292/44, 45, 52, 95, 96, 35, 166, 167, 292/168, 174, 186, 36, 41, 139; 220/23.88, 220/592.02; 312/402, 404; 62/382
See application file for complete search history.

(56) References Cited

U.S. PATENT DOCUMENTS 4,784,414 A * 11/1988 Free ..... E05C 9/08 292/336.3
5,417,080 A * 5/1995 Bishop ..... A23B 7/00 312/402
6,084,511 A * 7/2000 Kil ..... G08B 13/08 340/545.6
(Continued)

*Primary Examiner* — Len Tran
*Assistant Examiner* — Ana Vazquez
(74) *Attorney, Agent, or Firm* — Dentons US LLP

(57) ABSTRACT

A refrigerator includes: a refrigerator body having a cooling chamber; a case provided in the cooling chamber; a drawer having a handle, and accommodated in the case in a withdrawable manner; a sealing member provided at a contact region between the case and the drawer; a sealed state maintaining device having a locking portion provided at the case, and having a fixed arm disposed in the drawer, the fixed arm rotatable to a sealing position for sealing the drawer by compressing the sealing member by being coupled to the locking portion when the drawer is accommodated in the case, and a releasing position for releasing the sealed state by being separated from the locking portion; and a manipulation switch provided at the drawer, and configured to manipulate the fixed arm to move between the sealing position and the releasing position.

17 Claims, 19 Drawing Sheets

(51) Int. Cl.

| | |
|---|---|
| ***F25D 23/02*** | (2006.01) |
| ***F25D 23/08*** | (2006.01) |
| ***F25D 25/02*** | (2006.01) |
| ***E05B 65/00*** | (2006.01) |
| ***E05B 65/46*** | (2006.01) |
| ***E05C 3/00*** | (2006.01) |
| ***E05C 3/04*** | (2006.01) |
| ***E05C 3/08*** | (2006.01) |
| ***E05B 5/00*** | (2006.01) |
| ***E05B 17/00*** | (2006.01) |
| *F25D 17/04* | (2006.01) |

(56) References Cited

U.S. PATENT DOCUMENTS

| | | | | |
|---|---|---|---|---|
| 6,170,276 | B1 * | 1/2001 | Mandel | F25D 17/042 62/187 |
| 2004/0031705 | A1 * | 2/2004 | DeTemple, II | A47J 47/10 206/213.1 |
| 2007/0059406 | A1 * | 3/2007 | Shahsavarani | A23B 7/148 426/106 |
| 2010/0223944 | A1 * | 9/2010 | Tsujimoto | A23B 7/0433 62/264 |
| 2011/0297686 | A1 * | 12/2011 | Lim | E05B 17/0033 220/592.09 |

* cited by examiner

REFRIGERATOR WITH SEALED STATE MAINTAINING DEVICE FOR DRAWER

CROSS-REFERENCE TO RELATED APPLICATION

The present disclosure relates to subject matter contained in priority Korean Application Nos. 10-2012-0067585 and 10-2012-0077930, filed on Jun. 22 and Jul. 17, 2012, respectively, which are herein expressly incorporated by reference in their entireties.

BACKGROUND OF THE DISCLOSURE

1. Field of the Disclosure

The present disclosure relates to a refrigerator, and particularly, to a refrigerator capable of accommodating/withdrawing a drawer in/from a case in a convenient manner.

2. Background of the Disclosure

As is well known, a refrigerator is an apparatus for storing food items in a frozen or cool state.

The refrigerator may comprise a refrigerator body having a cooling chamber, and a door configured to open and close the cooling chamber.

A refrigerating cycle apparatus for providing cool air to the cooling chamber is provided at the refrigerator body.

FIG. 1 is a perspective view showing an example of a refrigerator in accordance with the related art.

As shown in FIG. 1, the refrigerator comprises a refrigerator body 10 having a cooling chamber 20, and a cooling chamber door 30 configured to open and close the cooling chamber 20.

The cooling chamber 20 is provided with a freezing chamber 21 and a refrigerating chamber 22.

The cooling chamber door 30 comprises a freezing chamber door 31 configured to open and close the freezing chamber 21, and a refrigerating chamber door 32 configured to open and close the refrigerating chamber 22.

A plurality of shelves 41, which is configured to partition the refrigerating chamber 22 up and down, may be provided in the refrigerating chamber 22.

A vegetable storage chamber 50, which is configured to store vegetables and/or fruits, is provided in the refrigerating chamber 22.

The vegetable storage chamber 50 may be formed in plurality.

Each of the vegetable storage chambers 50 is implemented as a drawer which can be accommodated in or withdrawn from the vegetable storage chamber 50 back and forth.

However, the refrigerator in accordance with the related art may have the following problems.

Firstly, air inside the refrigerating chamber 22 is in a state of relatively low temperature and low humidity. This may cause vegetables and fruits stored in the vegetable storage chamber 50 to become easily dried, resulting in shortening a storage period.

In order to solve such problem, has been used a vegetable storage chamber (not shown) having a sealing function, and capable of reducing its inner pressure into a value lower than the atmospheric pressure.

The vegetable storage chamber having a sealing function is provided with a sealed state maintaining device for maintaining a sealed state of a drawer when a drawer is accommodated in the vegetable storage chamber.

In the conventional refrigerator having such sealed state maintaining device, a user may have a difficulty in withdrawing and accommodating the drawer, because the refrigerator operates in a state where some components of the sealed state maintaining device are exposed to outside of the drawer.

Further, as foreign materials are inserted into components mounted outside the drawer, the operation of the components may be restricted.

SUMMARY OF THE DISCLOSURE

Therefore, an aspect of the detailed description is to provide a refrigerator capable of allowing a drawer to be accommodated in a case and withdrawn from the case in a simple manner.

Another aspect of the detailed description is to provide a refrigerator capable of preventing the occurrence of restrictions of components of a sealed state maintaining device for a sealed state of a drawer, by mounting the components in the drawer.

Still another aspect of the detailed description is to provide a refrigerator capable of prolonging a storage time of vegetables and fruits.

To achieve these and other advantages and in accordance with the purpose of this specification, as embodied and broadly described herein, there is provided a refrigerator, comprising: a refrigerator body having a cooling chamber; a case provided in the cooling chamber, and forming an accommodation space of which front surface is open; a drawer having a handle, and accommodated in the case in a withdrawable manner; a sealing member provided at a contact region between the case and the drawer, and configured to seal inside and outside of the drawer; a sealed state maintaining device having a locking portion provided at the case, and having a fixed arm disposed in the drawer, the fixed arm rotatable to a sealing position for sealing the drawer by compressing the sealing member by being coupled to the locking portion when the drawer is accommodated in the case, and a releasing position for releasing the sealed state by being separated from the locking portion; and a manipulation switch provided at the drawer in a spaced manner from the handle, and configured to manipulate the fixed arm to move between the sealing position and the releasing position.

The locking portion may protrude from a front surface of the case, and the drawer may be provided with an insertion hole for inserting the locking portion.

The manipulation switch may be rotatably disposed at the drawer, and a manipulation switch accommodation portion for rotatably accommodating the manipulation switch therein may be provided on a front surface of the drawer.

The refrigerator may further comprise a power transmission portion configured to transmit a driving force of the manipulation switch to the fixed arm.

The power transmission portion may comprise a driving arm coaxially formed with the fixed arm; and a connection rod having one side connected to the manipulation switch, and another side connected to the driving arm.

The sealed state maintaining device may be provided at two sides of the drawer, and the connection rod may extend toward two sides of the manipulation switch.

The fixed arm and the driving arm may be integrally formed with each other.

The locking portion may be provided with a contact portion having a circular section and contacting the fixed arm. And the fixed arm may be provided with a guide section for guiding contact with the contact portion.

The locking portion may be provided with a rolling contact member which rolling-contacts the fixed arm.

The refrigerator may further comprise an auditory information generator configured to generate auditory information when the manipulation switch moves to the releasing position.

The auditory information generator may comprise a communication portion configured to communicate inside and outside of the drawer with each other; and an opening/closing member configured to open and close the communication portion.

The communication portion may be provided at a rear side of the manipulation switch, and the opening/closing member may be provided between the manipulation switch and the communication portion. The opening/closing member may be configured to block the communication portion by being pressurized by the manipulation switch when the manipulation switch is on the sealing position.

The refrigerator may further comprise an opening/closing member spring configured to provide an elastic force such that the opening/closing member is separated from the communication portion.

The refrigerator may further comprise: a vegetable storage container provided in the cooling chamber; a vegetable storage container blocking portion provided outside the vegetable storage container, and forming a vegetable storage chamber therein together with the vegetable storage container; and a water supply device configured to supply water to inside of the vegetable storage chamber.

The water supply device may comprise: a tank configured to store water therein; and a spray portion configured to spray water inside the tank.

The refrigerator may further comprise a water collecting cover provided outside the vegetable storage container, and configured to guide collected water to the water supply device. The water collecting cover may comprise: a plate portion; and a channel portion provided below the plate portion, and forming a moving path of water therein.

The water supply device may further comprise a humidity adjustable element formed as a porous member, having one side connected to water supplied from the water supply device, having another side disposed in the vegetable storage chamber, and configured to evaporate water supplied from the water supply device from inside of the vegetable storage chamber.

The vegetable storage container may be provided with a through-hole, and a modified atmosphere film (MAF) may be provided at the through-hole.

The through-hole may be formed in plurality, and MAFs having different oxygen transmittances may be provided at the plurality of through-holes.

The vegetable storage chamber may be provided with a plurality of accommodation spaces partitioned from each other with the different through-holes.

The refrigerator may further comprise a protection member provided at one side or two sides of the MAF.

Each of the vegetable storage container and the vegetable storage container blocking portion may be formed in plurality, and the vegetable storage containers may be provided with MAFs having different gas transmittances.

The water supply device may be provided with an ozone water generator configured to generate ozone water, and the water supply device may be configured to supply ozone water generated from the ozone water generator to the vegetable storage chamber.

Further scope of applicability of the present application will become more apparent from the detailed description given hereinafter. However, it should be understood that the detailed description and specific examples, while indicating preferred embodiments of the disclosure, are given by way of illustration only, since various changes and modifications within the spirit and scope of the disclosure will become apparent to those skilled in the art from the detailed description.

BRIEF DESCRIPTION OF THE DRAWINGS

The accompanying drawings, which are included to provide a further understanding of the disclosure and are incorporated in and constitute a part of this specification, illustrate exemplary embodiments and together with the description serve to explain the principles of the disclosure.

In the drawings.

DETAILED DESCRIPTION OF THE DISCLOSURE

Description will now be given in detail of the exemplary embodiments, with reference to the accompanying drawings. For the sake of brief description with reference to the drawings, the same or equivalent components will be provided with the same reference numbers, and description thereof will not be repeated.

Hereinafter, a preferred embodiment of the present invention will be explained in more detail with reference to the attached drawings.

Figure 1:
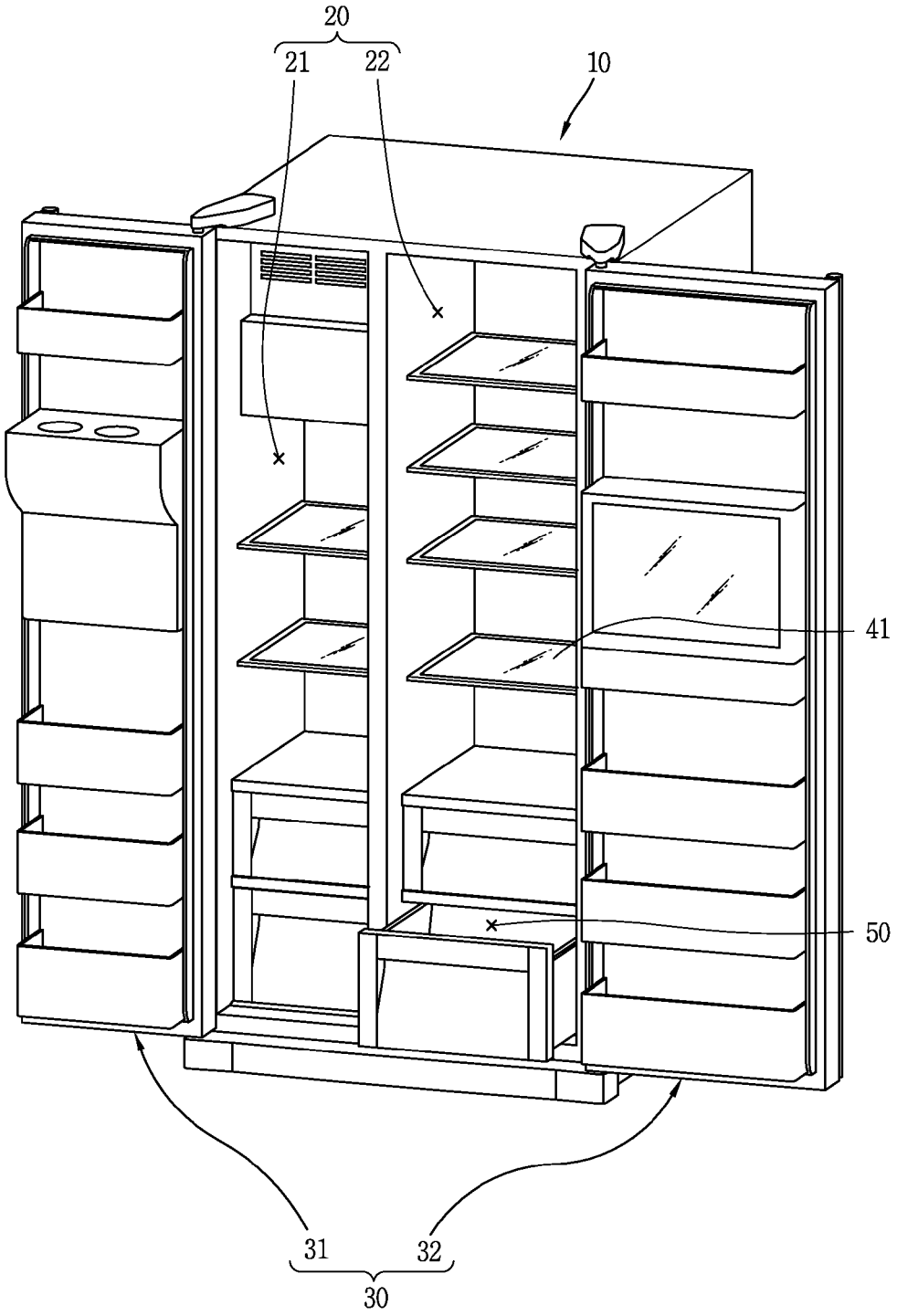
FIG. 1 RELATED ART
FIG. 1 is a perspective view illustrating an example of a refrigerator in accordance with the related art.
Figure 2:
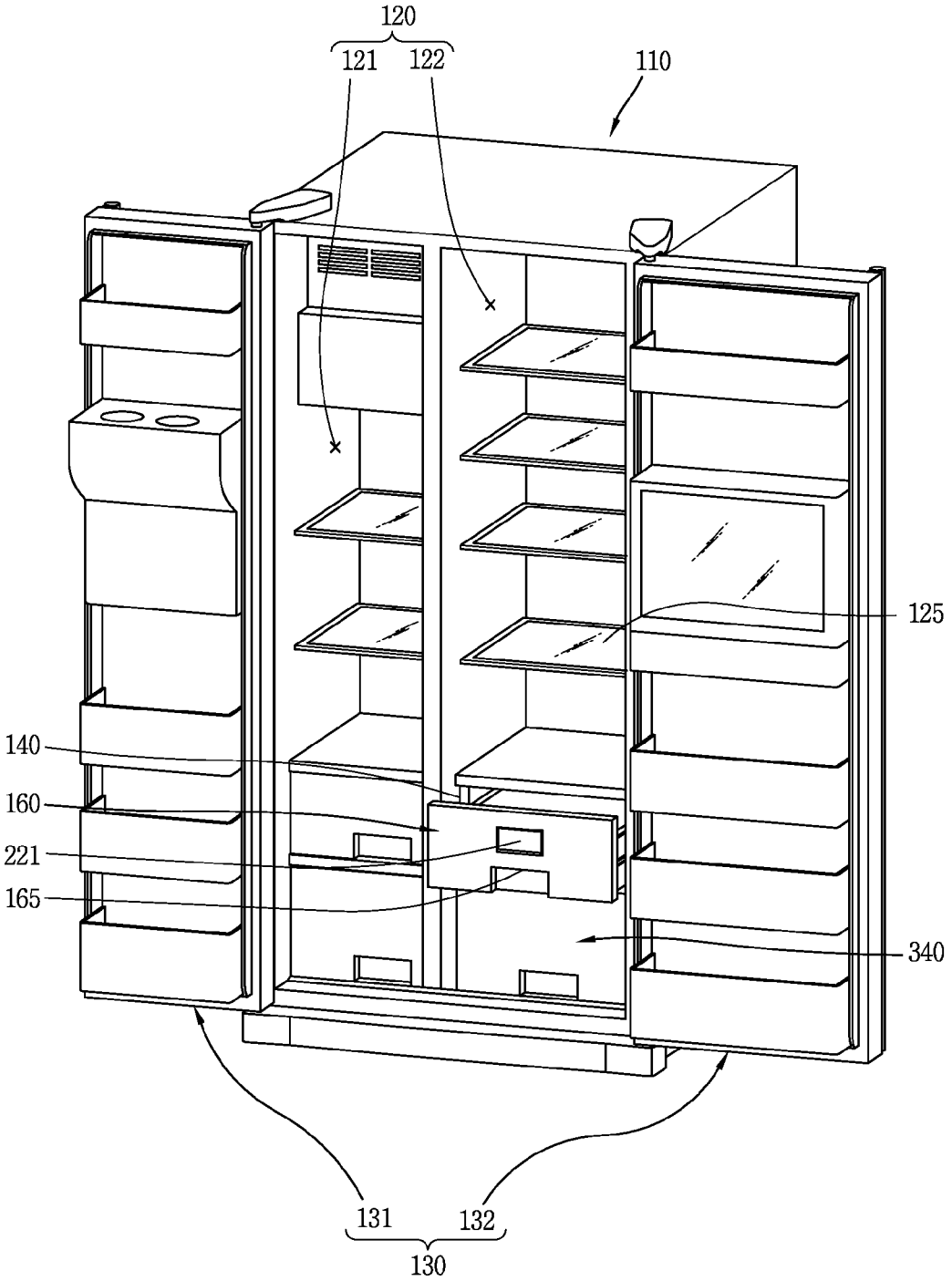
FIG. 2. is a perspective view of a refrigerator according to an embodiment of the present invention.
Figure 3:
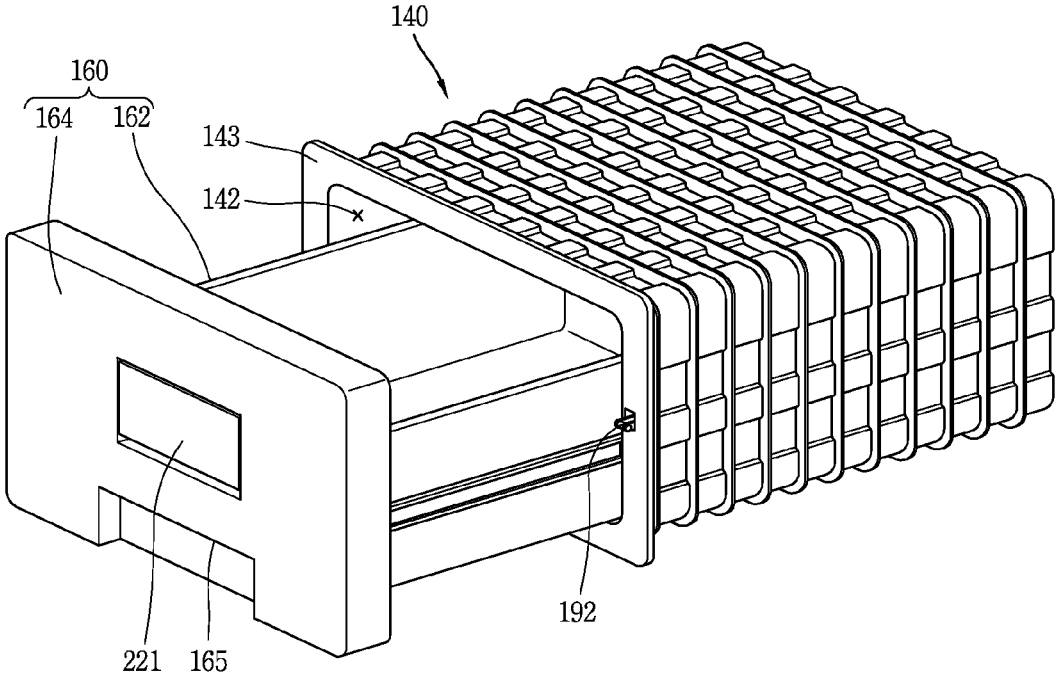
FIG. 3 is an enlarged perspective view of a drawer and a case of FIG. 2.
Figure 4:
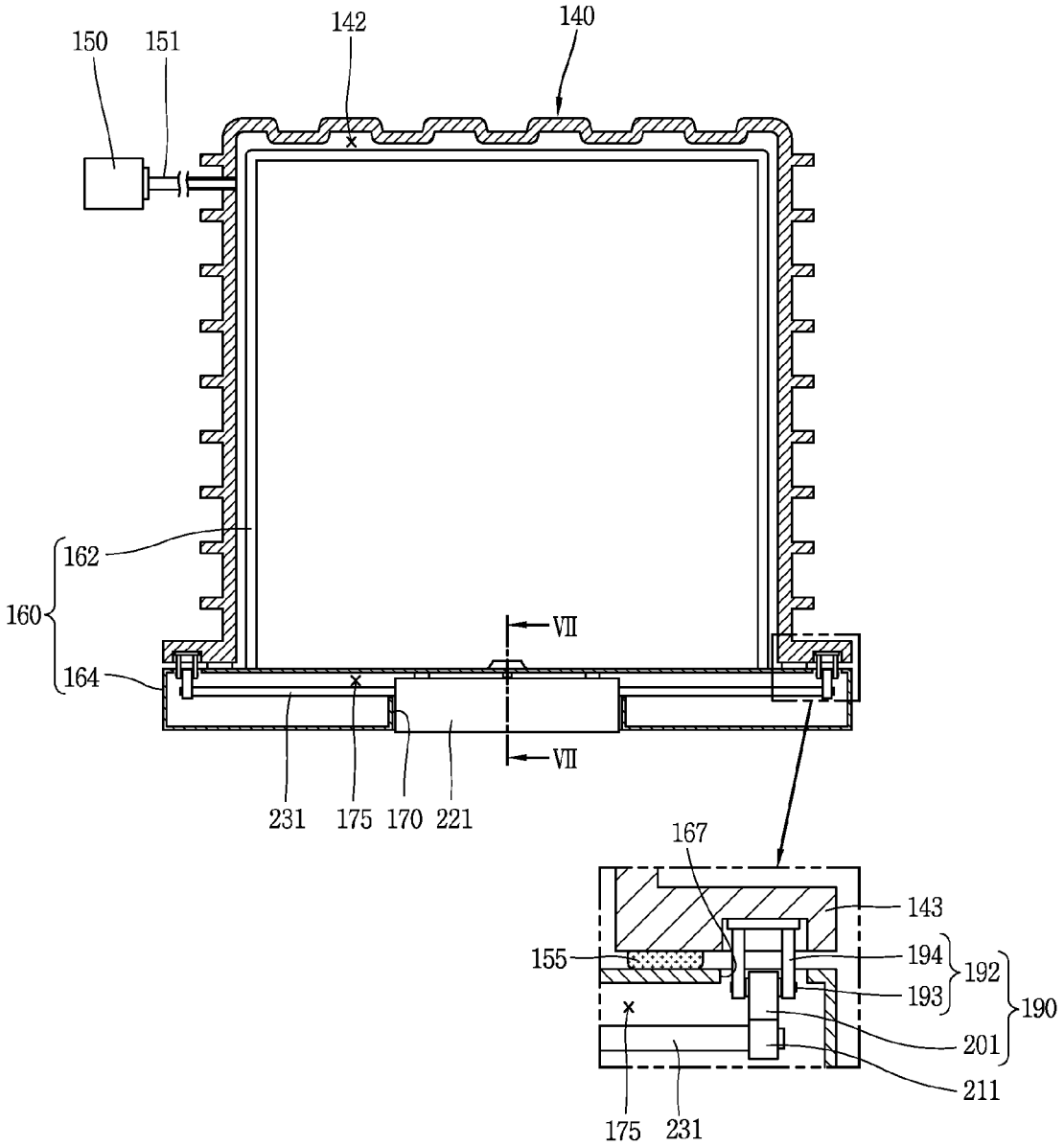
FIG. 4 is a planar sectional view illustrating an accommodated state of the drawer of FIG. 3.

As shown in FIGS. 2 to 4, a refrigerator according to an embodiment of the present invention comprises: a refrigerator body 110 having a cooling chamber 120; a case 140 provided in the cooling chamber 120, and forming an accommodation space of which front surface is open; a drawer 160 having a handle 165, and accommodated in the case 140 in a withdrawable manner; a sealing member 155 provided at a contact region between the case 140 and the drawer 160, and configured to seal inside and outside of the drawer when the drawer 160 is accommodated in the case 140; a sealed state maintaining device 190 having a locking portion 192 provided at the case 140, and having a fixed arm 201 disposed in the drawer 160, the fixed arm 201 rotatable to a sealing position for sealing the drawer by compressing the sealing member 155 by being coupled to the locking portion 192 when the drawer 160 is accommodated in the case 140, and a releasing position for releasing the sealed state by being separated from the locking portion 192; and a manipulation switch 221 provided at the drawer 160 in a spaced manner from the handle, and configured to manipulate the fixed arm 201 to move between the sealing position and the releasing position. The cooling chamber 120 indicates a space where food is stored in a cooled state. The cooling chamber 120 may be provided with a freezing chamber 121 and a refrigerating chamber 122. The refrigerator body 110 may be provided with one of the freezing chamber 121 and the refrigerating chamber 122.

A plurality of cooling chambers 120 may be provided in the refrigerator body 110.

A cooling chamber door 130, which is configured to open and close the cooling chamber 120, may be provided at the refrigerator body 110.

The cooling chamber door 130 may comprise a freezing chamber door 131 configured to open and close the freezing chamber 121, and a refrigerating chamber door 132 configured to open and close the refrigerating chamber 122.

A plurality of shelves 125, which is configured to partition an inner space of the refrigerating chamber 122 up and down, may be provided in the refrigerating chamber 122.

The drawer 160 may be provided in the refrigerating chamber 122. A vegetable storage container 340, configured to store vegetables and/or fruits, may be provided below the drawer 160.

The drawer 160 may be accommodated in the case 140 in a withdrawble manner.

An accommodation space 142, which has an open front surface, may be provided in the case 140.

The case 140 may be formed in a rectangular parallelepiped having an accommodation space 142 therein. More specifically, the case 140 may be formed such that its front surface through which the drawer 160 is accommodated or withdrawn is open, while the rest 5 surfaces are closed.

A pump (vacuum pump) 150 may be provided at one side of the case 140.

A connection pipe 151 may be provided between the pump 150 and the case 140. One end of the connection pipe 151 may be connected to inside of the case 140, and another end of the connection pipe 151 may be connected to a suction portion of the pump 150. Under such configuration, when the drawer 160 is accommodated in the case 140, air inside the case 140 may be discharged to depressurize inside of the case 140.

A flange portion 143, which extends toward outside, may be provided on the front surface of the case 140.

The drawer 160 may comprise an accommodation portion 162 having therein an accommodation space for accommodating food items, and a front surface portion 164 disposed on a front surface of the accommodation portion 162.

The front surface portion 164 may be formed to have a larger size than the accommodation portion 162.

The front surface portion 164 may be formed in an approximate rectangular (rectangular-parallelepiped) shape.

The front surface portion 164 may be provided with a space portion 175 for accommodating components therein.

The front surface portion 164 may be formed to be contactable with a flange portion 143 of the case 140.

A handle 165, which is configured to facilitate withdrawal or accommodation of the drawer 160, may be provided at the front surface portion 164.

The handle 165 may be provided at a lower region of the front surface portion 164.

The handle 165 may be concaved backwardly from the surface of the front surface portion 164, so that a grasping space can be formed.

A sealing member 155, which is configured to seal inside of the drawer 160 when the drawer 160 is accommodated in the case 140, may be provided at a contact region between the front surface portion 164 and the case 140.

The sealing member 155 may be formed of rubber.

The sealing member 155 may be formed to have a closed-loop shape along the edge of a front opening of the case 140.

A sealed state maintaining device 190, which is configured to maintain a sealed state of the drawer 160, the case 140 and the sealing member 155, when the drawer 160 is accommodated in the case 140, may be provided between the case 140 and the drawer 160.

Figure 5:
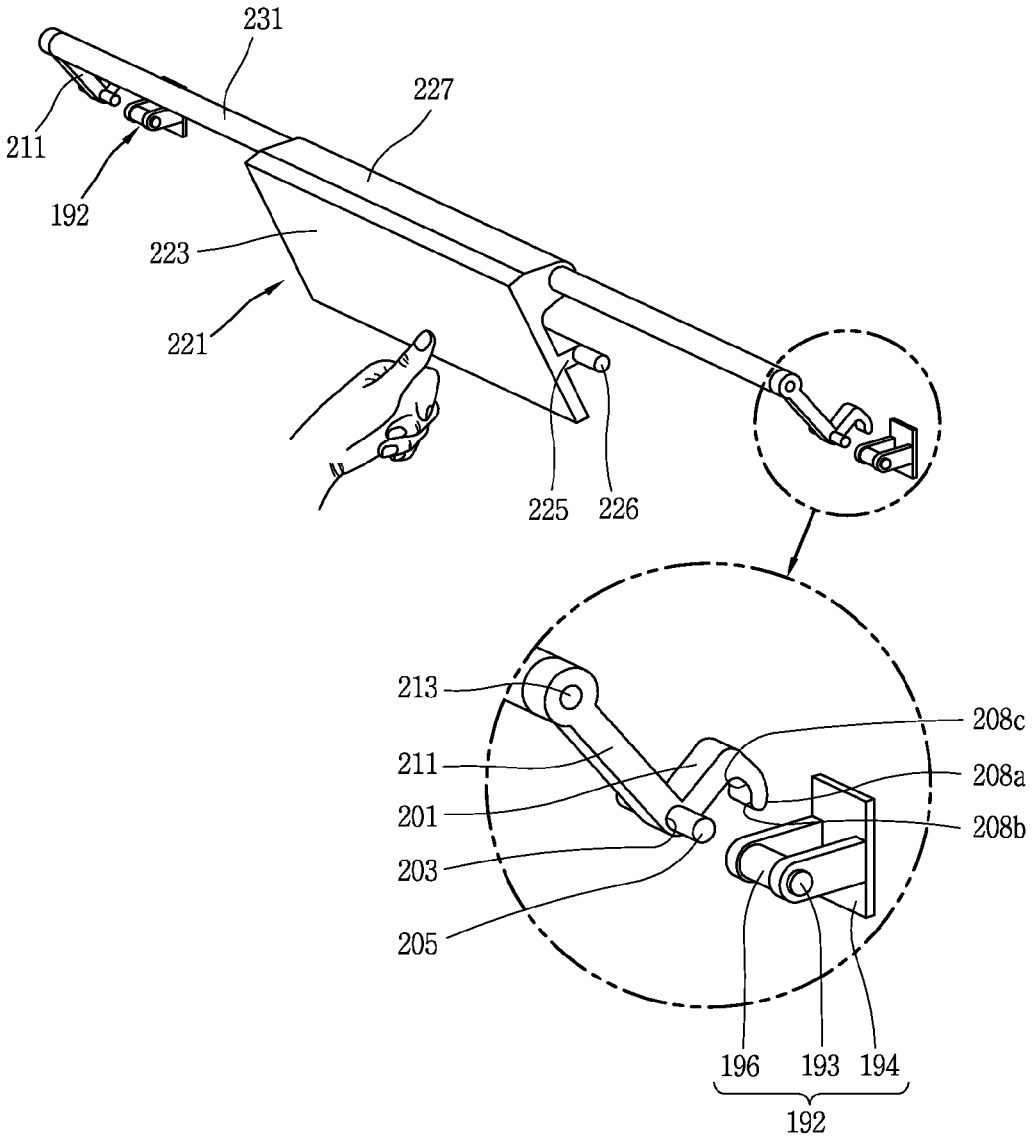
FIG. 5 is a perspective view illustrating a configuration of a sealed state maintaining device for a sealed state of the drawer of FIG. 3.

As shown in FIG. 5, the sealed state maintaining device 190 may comprise a locking portion 192 provided at the case 140, and a fixed arm 201 disposed in the drawer 160. The fixed arm 201 is rotatable to a sealing position for sealing the drawer by compressing the sealing member 155 by being coupled to the locking portion 192 when the drawer 160 is accommodated in the case 140, and a releasing position for releasing the sealed state by being separated from the locking portion 192.

The locking portion 192 may protrude from the front surface of the case 140.

The locking portion 192 may be formed in plurality.

The locking portion 192 may be formed two, and the two locking portions 192 may be provided at two sides of the front surface (flange portion 143) of the case 140.

The locking portions 192 may be inserted into insertion holes 167 formed at two sides on a rear surface of the front surface portion 164 of the drawer 160, when the drawer 160 is accommodated in the case 140.

The locking portion 192 may be formed so that the end of the fixed arm 201 can be inserted thereinto.

More specifically, the locking portion 192 may be provided with a contact portion 193 having a circular section and contacting the fixed arm 201. The contact portion 193 may be formed to have a 'U' shape.

The locking portion 192 may further comprise a coupling portion 194 connected to the contact portion 193, and configured to couple the contact portion 193 to the case 140.

The coupling portion 194 may be coupled to the flange portion 143 of the case 140 by supporting two ends of the contact portion 193.

The locking portion 192 may be provided with a rolling contact member 196 which rolling-contacts the fixed arm 201.

The rolling contact member 196 may be formed in a cylindrical shape.

The rolling contact member 196 may be rotatably coupled to the contact portion 193.

The fixed arm 201 may be provided at the space portion 175 disposed in the front surface portion 164 of the drawer 160, so as to be coupled to the locking portion 192 inserted into the insertion hole 167.

The fixed arm 201 may be coupled to a rotation shaft 205, and may be rotatable centering around the rotation shaft 205.

A rotation shaft accommodation portion 203, which is configured to rotatably accommodate the rotation shaft 205 therein, may be provided at one end of the fixed arm 201. The fixed arm 201 may be provided with a rotation shaft, rather than the rotation shaft accommodation portion 203. And rotation shaft accommodation portion 203 may be provided at the front surface portion 164 of the drawer 160.

The fixed arm 201 may be formed in an approximate 'L' shape where a bending end 207 is formed at another end, the bending end 207 locked by being inserted into the locking portion 192.

Figure 6:
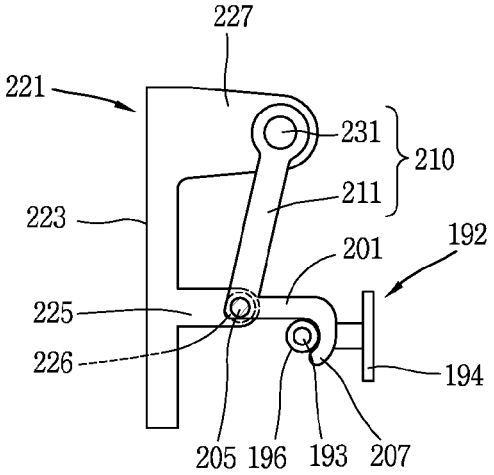
FIG. 6 is a side sectional view illustrating a coupled state of a fixed arm of FIG. 5 to a contact portion.
Figure 10:
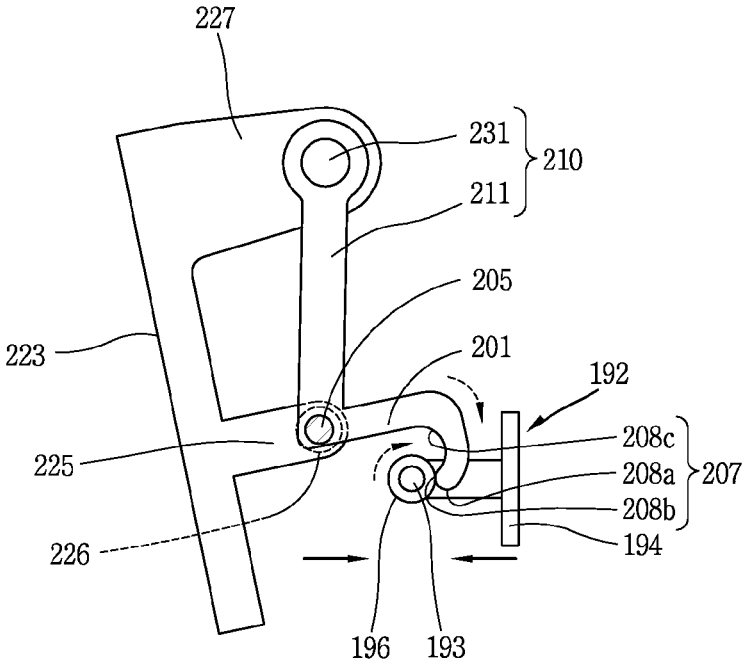

As shown in FIGS. 6 and 10, the bending end 207 may comprise a guiding section 208*a* contacting an outer surface of the contact portion 193, and guiding the fixed arm 201 to move to the sealing position; a pressurizing section 208*b* protruding toward the rotation shaft 205 at one side of the guiding section 208*a*, and configured to pressurize the locking portion 192 and the fixed arm 201 so that they are close to each other; and a maintaining section 208*c* formed at one side of the pressurizing section 208*b* so as to be more spaced from the rotation shaft 205 than the pressurizing section 208*b*, and configured to maintain a coupled state between the bending end 207 and the locking portion 192. The maintaining section 208*c* may be provided with a curvature radius corresponding to an outer diameter of the rolling contact member 196. Under such configuration, a contact state between the bending end 207 and the rolling contact member 196 may be stably maintained.

The refrigerator may further comprise a power transmission portion 210 configured to transmit a driving force of the manipulation switch 221 to the fixed arm 201.

The power transmission portion 210 may comprise a driving arm 211 coaxially formed with the fixed arm 201; and a connection rod 231 having one side connected to the manipulation switch 221, and another side connected to the driving arm 211.

The driving arm 211, which is configured to drive the fixed arm 201 to rotate between the sealing position and the releasing position, may be provided at one side of the fixed arm 201.

The fixed arm 201 and the driving arm 211 may be formed as a single body.

The driving arm 211 may extend, from the rotation shaft accommodation portion 203 of the fixed arm 201, with a prescribed inner angle, along a radius direction of the rotation shaft 205.

A connection rod coupling portion 213 may be provided at another end of the driving arm 211, so as to be coupled to the end of the connection rod 231. For instance, the connection rod coupling portion 213 may be penetratingly-formed so that one end of the connection rod 231 can be inserted thereinto. Although not shown, the connection rod coupling portion 213 may be configured so that the connection rod 231 coupled thereinto can perform a relative motion. For instance, in a case where an orbit center of the connection rod 231 and a rotation center of the driving arm 211 are different from each other, the connection rod coupling portion 213 may be formed in a long slit so that the connection rod 231 can perform a relative motion.

A manipulation switch 221, which is configured to open and close the sealed state maintaining device 190, may be provided at the drawer 160.

The manipulation switch 221 may be rotatably provided at the front surface of the drawer 160.

A manipulation switch accommodation portion 170, which is configured to rotatably accommodate the manipulation switch 221, may be formed at the front surface of the drawer 160.

Figure 7:
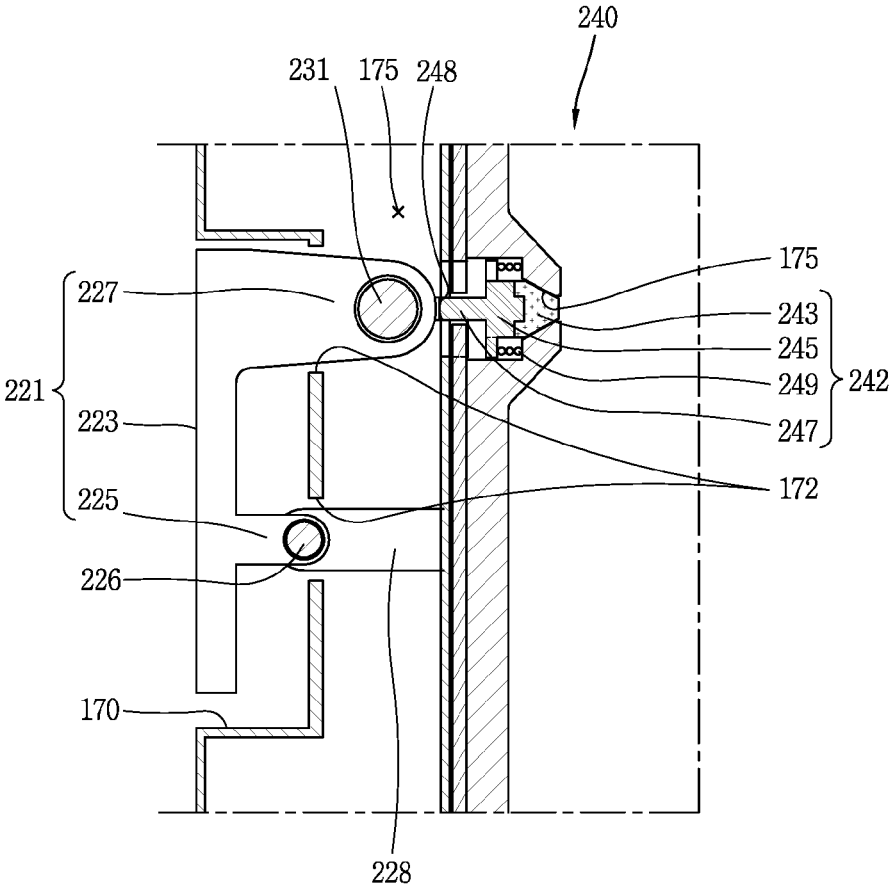
FIG. 7 is a sectional view of a manipulation switch, which is taken along line VII-VII' in FIG. 4.

As shown in FIG. 7, the manipulation switch accommodation portion 170 may be inwardly concaved from the front surface portion 164 of the drawer 160, along a thickness direction.

The manipulation switch 221 may comprise a plate portion 223 which can be pressurized, and a rotation shaft supporting portion 225 configured to support the rotation shaft 226 disposed at a rear surface of the plate portion 223 in a spaced manner. The rotation shaft 226 may be coupled to a rotation shaft coupling portion 228 provided at the drawer 160, and may be supported by the rotation shaft coupling portion 227.

The plate portion 223 may be formed as a rectangular plate, for instance.

A connection rod insertion portion 227, which is configured to insert the connection rod 231 thereinto, may be provided at a rear side of the plate portion 223 so as to be supported by the plate portion 223. Under such configuration, the connection rod 231 can orbit when the plate portion 223 rotates.

The connection rod 231 may extend to two sides of the manipulation switch 221 with its long length.

The driving arms 211 for driving the fixed arms 201 may be coupled to two ends of the connection rod 231. Under such configuration, the fixed arms 201, which are disposed at two sides of the connection rod 231, may be rotatable to a sealing position or a releasing position by the manipulation switch 221.

The connection rod insertion portion 227 may be disposed above the rotation shaft supporting portion 225 in parallel.

A through hole 172, which is configured to inset the rotation shaft supporting portion 225 and the connection rod insertion portion 227 thereinto, may be provided at the manipulation switch accommodation portion 170 of the drawer 160.

A space portion 175, which is configured to movably (rotatably) accommodate therein operation components, e.g., the connection rod 231, the driving arm 211 and the fixed arm 201, may be provided in the front surface portion 164 of the drawer 160.

An auditory information generator 240, which is configured to generate auditory information when the manipulation switch 221 moves to a releasing position, may be provided at the drawer 160. The auditory information may be a sound indicating a released state (or vacuum-released state) of the sealed state maintaining device 190.

The auditory information generator 240 may comprise a communication portion 175 configured to communicate inside and outside of the drawer 160 with each other, and an opening/closing member 242 configured to open and close the communication portion 175.

Figure 8:
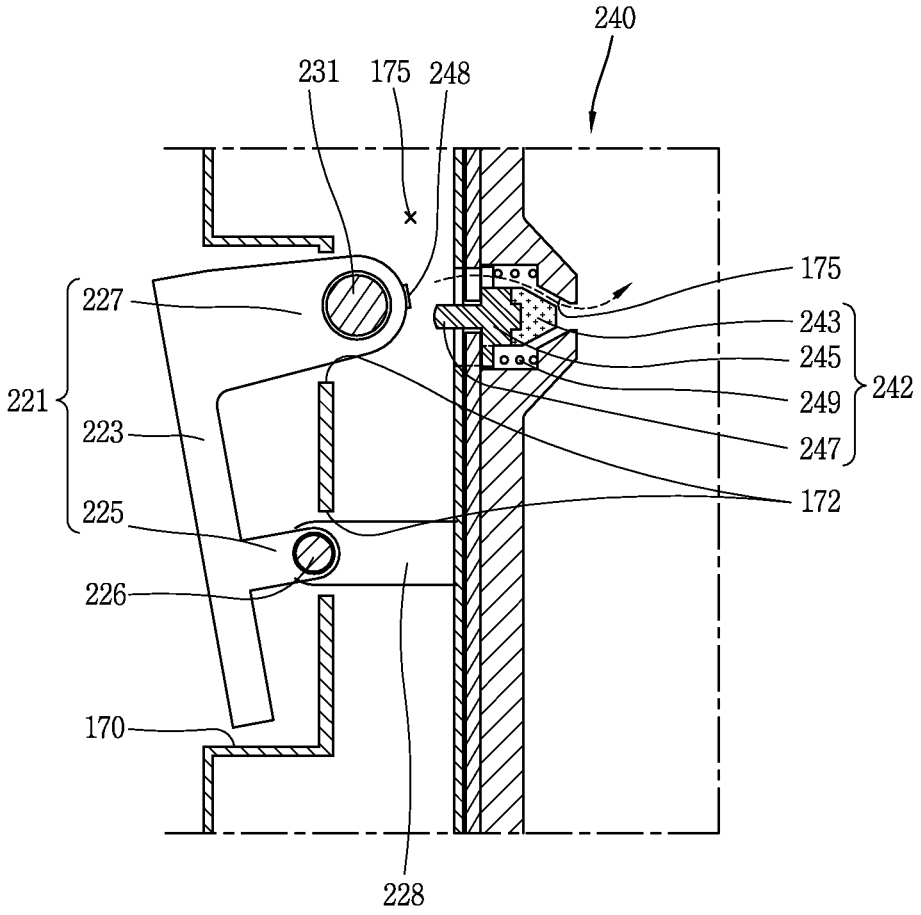
FIG. 8 is a view for explaining an operation of the manipulation switch of FIG. 7.

As shown in FIG. 8, the communication portion 175 may be formed at a rear region of the manipulation switch 221, by passing through the front surface portion 164. Under such configuration, when the drawer 160 is accommodated in the case 140, inside and outside of the drawer 160 may be communicated with each other through the communication portion 175. The communication portion 175 may be configured to generate a sound (auditory information) as external air is introduced thereinto when it is open. Under such configuration, a user may precisely recognize a vacuum-released state by a sound generated from the communication portion, when the manipulation switch 221 rotates to a releasing position. This can enhance a user's satisfaction degree. The size and the number of the communication portions 175 may be properly configured so that auditory information can be generated, the auditory information having a sound intensity large enough for a user to recognize a vacuum-released state.

An opening/closing member 242, which is configured to open and close the communication portion 175, may be provided at the communication portion 175.

The opening/closing member 242 may be provided with an elastic portion 243 inserted into the communication portion 175.

The elastic portion 243 may be formed of rubber having elasticity.

The opening/closing member 242 may be provided with a supporting portion 245 formed of a reinforcing member (e.g., synthetic resin) and supporting the elastic portion 243.

The supporting portion 245 may be provided with a pressurized portion 247 protruding toward the manipulation switch 221, and pressurized by contacting the manipulation switch 221.

A pressurizing portion 248, which is configured to pressurize the pressurized portion 247 by contacting the pressurized portion 247, may be formed at the manipulation switch 221.

The pressurizing portion 248 may backwardly protrude from the connection rod insertion portion 227.

The pressurizing portion 248 and the pressurized portion 247 may be formed to have a size large enough for the elastic portion 243 to block the communication portion 175, the elastic portion 243 inserted into the communication portion 175 by being pressurized by a rotation force of the manipulation switch 221 when the manipulation switch 221 rotates to a sealing position.

An opening/closing member spring 249, which is configured to provide an elastic force so that the opening/closing member 242 can be separated from the communication portion 175, may be provided at one side of the opening/closing member 242. Under such configuration, when the manipulation switch 221 rotates to a releasing position, the elastic portion 243 is separated from the communication portion 175 by an elastic force of the opening/closing member spring 249. As a result, the communication portion 175 is open.

The refrigerator according to this embodiment may be provided with a pump controller 250 for controlling the pump 150 so that inside of the drawer 160 and the case 140 can be depressurized when the sealed state maintaining device 190 is on a sealing position.

Figure 12:
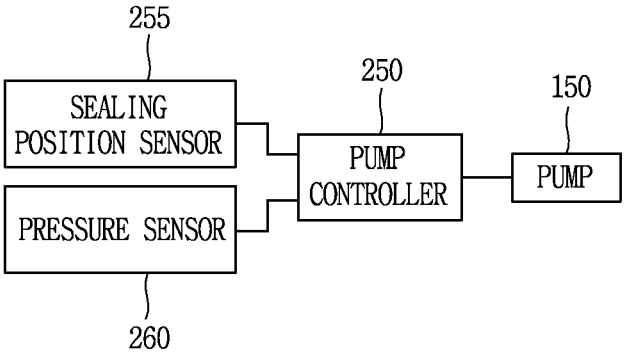
FIG. 12 is a control block diagram of the refrigerator of FIG. 2.

As shown in FIG. 12, a sealing position sensor 255, which is configured to sense a sealing position of the manipulation switch 221 and/or the fixed arm 201, may be controllably connected to the pump controller 250.

A pressure sensor 260 for sensing an inner pressure of the case 140, and the pump 150 may be controllably connected to the pump controller 250.

Once the manipulation switch 221 or the fixed arm 201 is positioned on a sealing position by the sealing position sensor 255, the pump controller 250 may depressurize inside of the case 140 by controlling the pump 150. Once the pressure sensed by the pressure sensor 260 reaches a preset pressure, the pump controller 250 may stop the operation of the pump 150.

Under such configuration, the manipulation switch 221 is disposed on a releasing position before the drawer 160 is accommodated in the case 140. When the manipulation switch 221 is disposed on the releasing position, the manipulation switch 221 rotates so that the plate portion 223 can be inclined, i.e., an upper region of the plate portion 223 can protruded forwardly and a lower region thereof can move backwardly, as shown in FIG. 8.

As a rear region of the drawer 160 is inserted into the case 140 and the drawer 160 is pressurized backwardly, the drawer 160 may be accommodated in the case 140.

Once the drawer 160 is accommodated in the case 140, the sealing member 155 may contact the flange portion 143 of the case 140. The locking portion 192 of the case 140 may be inserted into the insertion hole 167 formed on a rear surface of the front surface portion 164 of the drawer 160.

In order to depressurize (vacuumize) inside of the drawer 160 and the case 140, the manipulation switch 221 may be controlled to move to a sealing position.

Once an upper region of the manipulation switch 221 is pressurized backwardly, the manipulation switch 221 may rotate centering around the rotation shaft 226.

Once the manipulation switch 221 rotates centering around the rotation shaft 226, the connection rod 231 may move (orbit) backwardly. Under such configuration, the driving arms 211, which have been coupled to two ends of the connection rod 231, may rotate as shown in FIG. 9.

While the driving arm 211 rotates, the fixed arm 201 rotates and the bending end 207 of the fixed arm 201 contacts the rolling contact member 196 of the locking portion 192.

Figure 9:
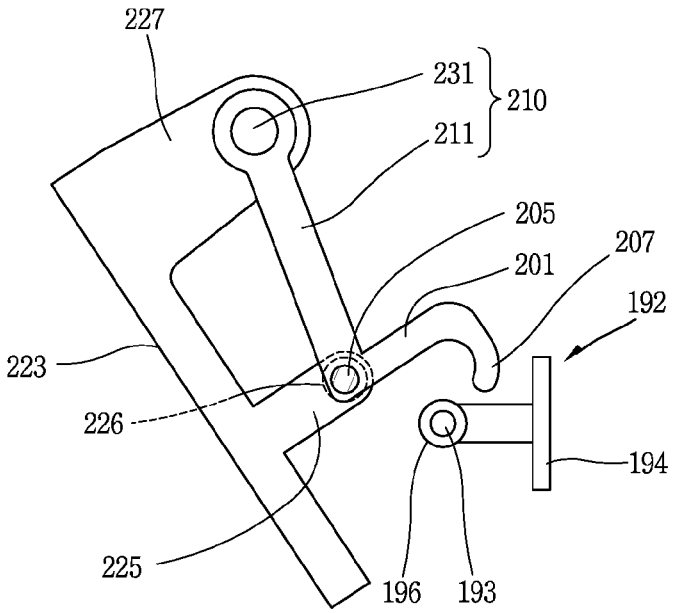
FIGS. 9 and 10 are views illustrating a process that the fixed arm of FIG. 6 rotates to a sealing position.

More specifically, if the fixed arm 201 clockwise rotates as shown in FIG. 9, the guiding section 208*a* of the fixed arm 201 may contact an outer surface of the rolling contact member 196.

If the fixed arm 201 continuously rotates, the rolling contact member 196 performs a relative motion by rolling-contacting (rotation) the guiding section 208*a*. As shown in FIG. 10, the rolling contact member 196 may contact the pressurizing section 208*b* of the bending end 207.

Figure 11:
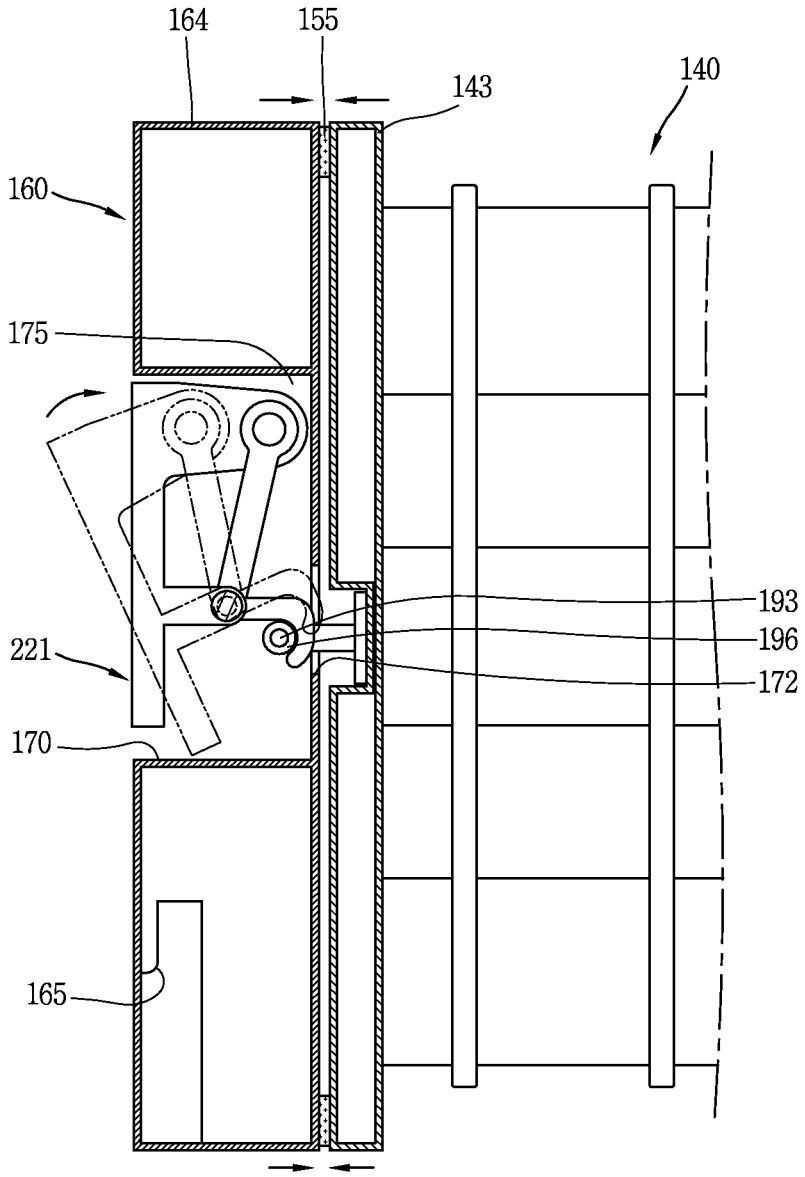
FIG. 11 is a view for explaining a state of a drawer when the fixed arm of FIG. 10 is coupled to a contact portion.

Once the pressurizing section 208*b* and the rolling contact member 196 come in contact with each other, the fixed arm 201 and the locking portion 192 may be pressurized toward an approaching direction. Under such configuration, as shown in FIG. 11, the drawer 160 and the case 140 are close to each other and the sealing member 155 is compressed, so that inside of the case 140 and the drawer 160 can be sealed.

Once the manipulation switch 221 rotates to a sealing position, the pressurizing portion 248 may come in contact with the pressurized portion 247. If the manipulation switch 221 continuously rotates, the pressurized portion 247 is pressurized by the pressurizing portion 248, and the elastic portion 243 is inserted into the communication portion 175. As a result, the communication portion 175 may be blocked.

Upon completion of the rotation of the manipulation switch 221 and the fixed arm 201, the maintaining section 208*c* of the fixed arm 201 contacts the rolling contact member 196, and the fixed arm 201 comes in plane-contact with the rolling contact member 196 to thus maintain a stable contact state.

Once a sealing position of the manipulation switch 221 or the fixed arm 201 is sensed by the sealing position sensor 255, the pump controller 250 may operate the pump 150. Once the pump 150 operates, air inside the sealed case 140 and drawer 160 is discharged to outside through the connection pipe 151. Accordingly, the case 140 and the drawer 160 may be depressurized into a preset pressure (or vacuum degree). If the pressure sensed by the pressure sensor 260 reaches a preset pressure, the pump controller 250 controls the pump 150 to be stopped.

If the drawer 160 is to be withdrawn, the manipulation switch 221 may be controlled so as to move to a releasing position. If a lower region of the manipulation switch 221 is pressurized backwardly, the manipulation switch 221 may rotate centering around the rotation shaft 226 so as to be inclined, i.e., an upper region of the manipulation switch 221 protrudes forwardly and a lower region thereof moves backwardly.

Once the manipulation switch 221 rotates to a releasing position, the connection rod 231 may orbit centering around the rotation shaft 226 to thus move forwardly.

Once the connection rod 231 moves forwardly, each of the driving arm 211 and the fixed arm 201 may rotate in a counterclockwise direction.

If the driving arm 211 rotates, the fixed arm 201 may be separated from the contact portion 193, in an opposite manner from a coupling process to the contact portion 193. More specifically, as the pressurizing section 208*b* and the guiding section 208*a* come in contact with the rolling contact member 196 at the maintaining section 208*c*, the fixed arm 201 is separated from the contact portion 193.

Once the manipulation switch 221 rotates to a releasing position, the opening/closing member 242 may be separated from the communication portion 175 by an elastic force of the opening/closing member spring 249. If the communication portion 175 is open, external air may be introduced into the drawer 160 through the communication portion 175, due to a pressure difference between inside and outside of the drawer 160. During such process, auditory information due to introduction of air may be generated. A user may recognize a vacuum-released state, thereby having an enhanced satisfaction degree.

Upon completion of the rotation of the manipulation switch 221 to the releasing position, a user withdraws the drawer 160 from the case 140 while forwardly pulling the drawer 160 with holding the handle 165.

Hereinafter, a refrigerator according to still another embodiment of the present invention will be explained with reference to FIGS. 13 to 15.

The same components as those of the aforementioned embodiment will be provided with the same reference numerals, and detailed explanations thereof will be omitted.

Figure 13:
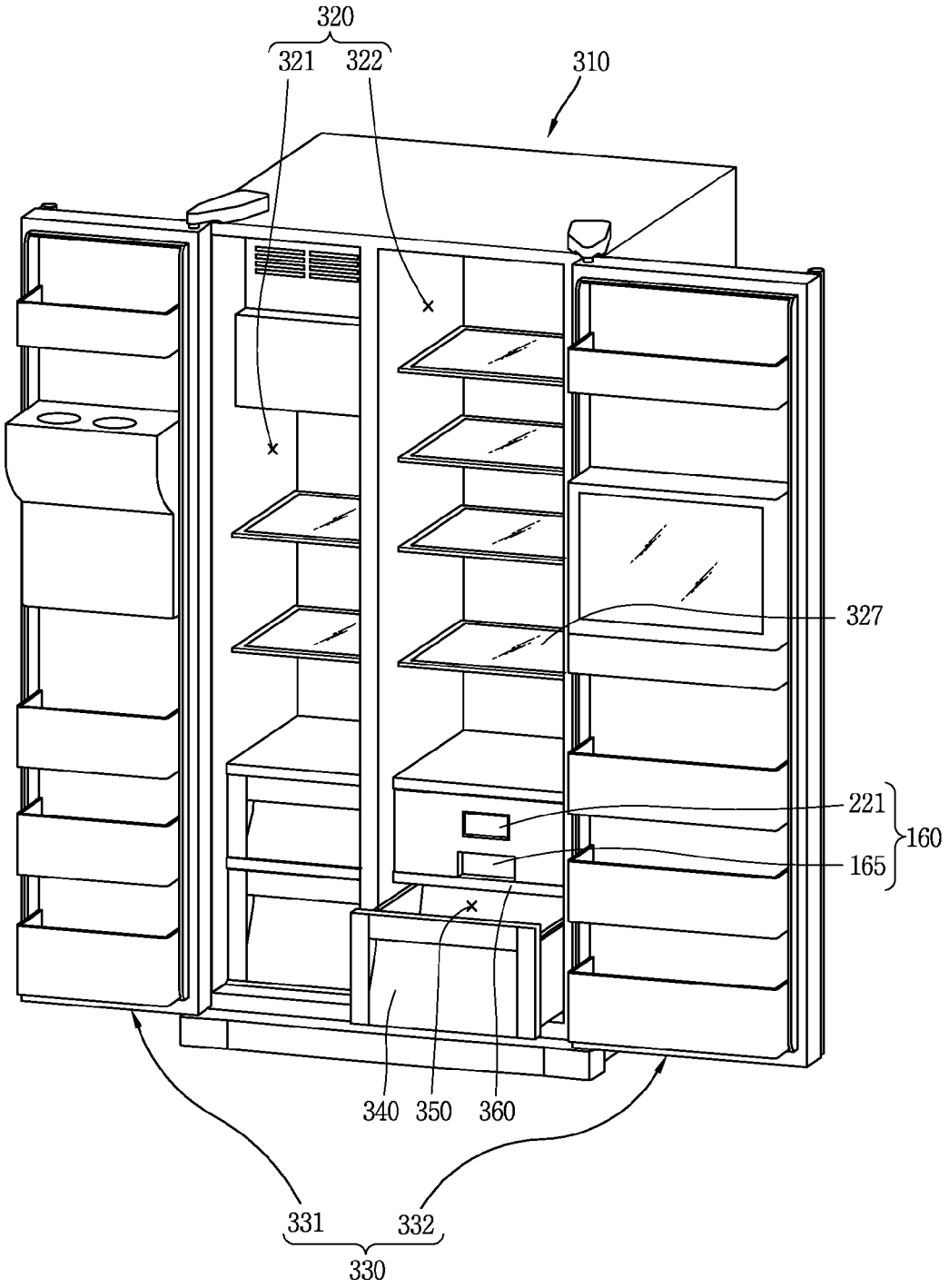
FIG. 13 is a perspective view of a refrigerator according to another embodiment of the present invention.
Figure 14:
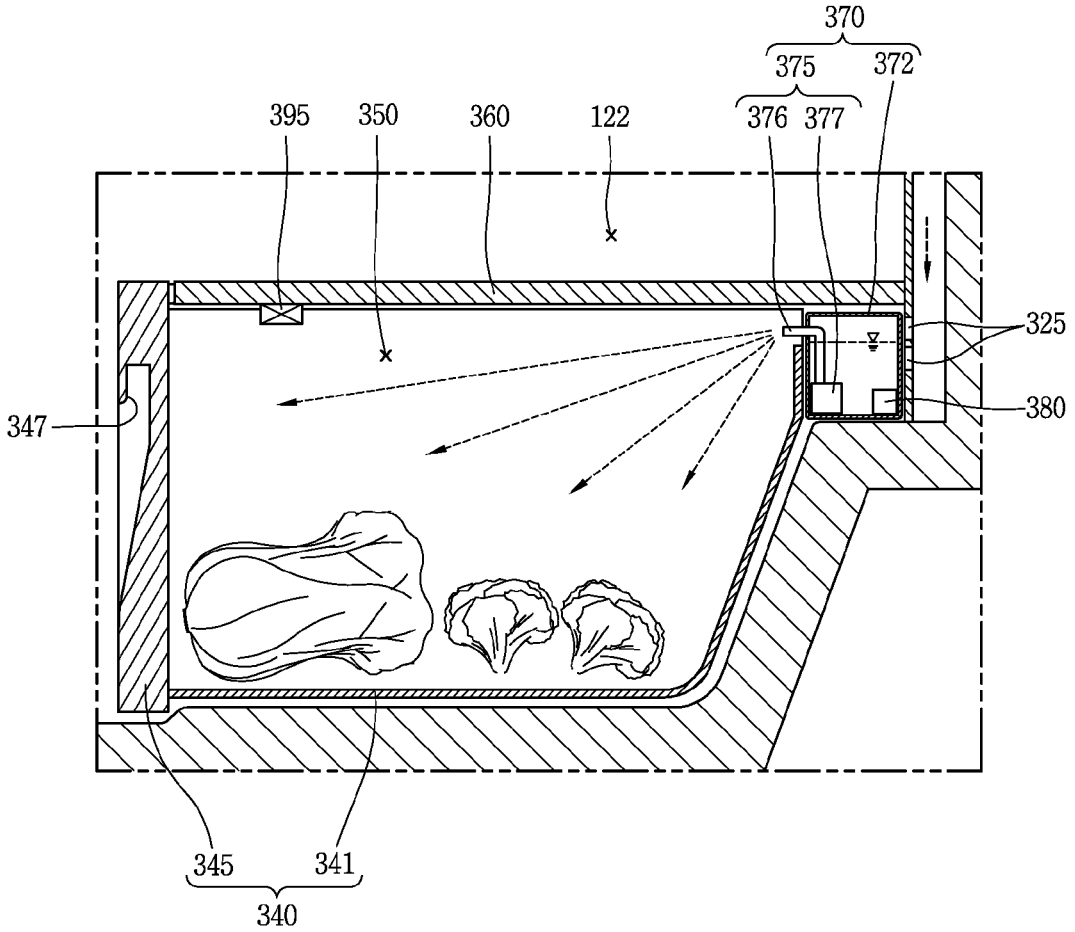
FIG. 14 is a sectional view of a vegetable storage chamber of FIG. 13.

As shown in FIGS. 13 and 14, a refrigerator according to still another embodiment of the present invention may comprise: a refrigerator body 110 having a cooling chamber 120; a vegetable storage container 340 provided in the cooling chamber 120; a vegetable storage container blocking portion 360 provided outside the vegetable storage container 340, and forming a vegetable storage chamber 350 therein together with the vegetable storage container 340; and a water supply device 370 configured to supply water to inside of the vegetable storage chamber 350. The cooling chamber 120 indicates a space where food is stored in a cooled state. The cooling chamber 120 may be provided with a freezing chamber 121 and a refrigerating chamber 122.

The refrigerator body 110 may be provided with a plurality of cooling chambers 120.

The refrigerator body 110 is provided with a cooling chamber door 130 configured to open and close the cooling chamber 120.

The cooling chamber door 130 comprises a freezing chamber door 131 configured to open and close the freezing chamber 121, and a refrigerating chamber door 132 configured to open and close the refrigerating chamber 122.

A plurality of shelves 127, which is configured to partition an inner space of the refrigerating chamber 122 up and down, may be provided in the refrigerating chamber 122.

A case 140, and a drawer 160 which is accommodated in the case 140 in a withdrawable manner, may be provided at a lower region of the refrigerating chamber 122.

A vegetable storage container 340, configured to store vegetables and/or fruits, may be provided in the refrigerating chamber 122.

The vegetable storage container 340 may be implemented as a drawer of which upper side is open.

The vegetable storage container blocking portion 360, which is configured to block an upper opening when the vegetable storage container 340 is accommodated in the refrigerating chamber 122, may be provided above the vegetable storage container 340. Under such configuration, the vegetable storage chamber 350 may be formed between the vegetable storage container 340 and the vegetable storage container blocking portion 360.

The vegetable storage container blocking portion 360 may be formed in an approximate rectangular plate shape. In this embodiment, the vegetable storage container blocking portion 360 is formed in a rectangular plate shape. However, the vegetable storage container blocking portion 360 may be implemented as a rectangular box for accommodating the vegetable storage container 340 therein in a withdrawable manner.

The vegetable storage container 340 may comprise an accommodation portion 341 configured to accommodate therein vegetables or fruits, and a front surface portion 345 disposed on a front surface of the accommodation portion 341. A handle 347, which is configured to facilitate withdrawal or accommodation of the drawer 160, may be provided at the front surface portion 345.

The vegetable storage chamber 350 may be sealed by a gasket (not shown) further provided. The gasket is formed at a contact region between the vegetable storage container 340 and the vegetable storage container blocking portion 360, and is configured to seal inside of the vegetable storage chamber 350 from outside.

A water supply device 370, which is configured to supply water to inside of the vegetable storage container 340, may be provided in the refrigerating chamber 122.

The water supply device 370 may be disposed at a rear region of the vegetable storage container 340. In this embodiment, the water supply device 370 is disposed at a rear side of the vegetable storage container 340. However, the water supply device 370 may be disposed in the vegetable storage container 340.

A cool-air outlet 325, through which cool air is discharged out, may be provided at a rear region of the water supply device 370. Under such configuration, cool air discharged through the cool-air outlet 325 may come in contact with the water supply device 370.

The water supply device 370 may comprise a tank 372 (or vessel) configured to store water therein, and a spray portion 375 configured to spray water inside the tank 372.

The spray portion 375 may be provided with an injection nozzle 376 configured to inject water toward the vegetable storage container 340, and a pump 177 configured to pump water inside the tank 372 to the injection nozzle 376. The injection nozzle 376 of the spray portion 375 may be configured to be inserted into the vegetable storage chamber 350 when the vegetable storage container 340 is accommodated in the refrigerating chamber 122.

An ozone water generator 380, which is configured to generate ozone water, may be provided in the tank 372 of the water supply device 370. Under such configuration, pollution and decay (decomposition) of water inside the tank 372 can be prevented by a sterilization effect using ozone water. Further, as the ozone water is sprayed into vegetables and/or fruits, the vegetables and/or the fruits can be stored for a longer period of time by a sterilization effect by the ozone water.

The ozone water generator 380 may be configured to generate ozone water at preset time intervals.

The refrigerator according to this embodiment may comprise a water supply device controller 3900 configured to control the water supply device 370, based on humidity inside the vegetable storage chamber 350.

A humidity sensor 395, which is configured to sense humidity inside the vegetable storage chamber 350, may be provided at the refrigerating chamber 122.

Figure 15:
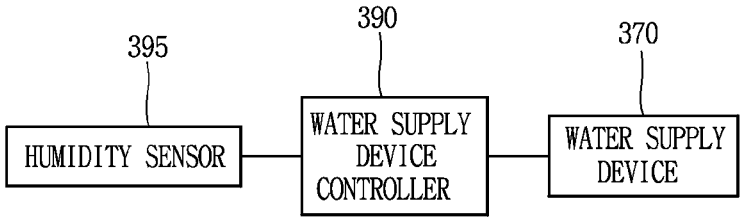
FIG. 15 is a control block diagram of the refrigerator of FIG. 13.

As shown in FIG. 15, each of the humidity sensor 395 and the water supply device 370 may be controllably connected to the water supply device controller 390.

Under such configuration, once vegetables and/or fruits are accommodated in the vegetable storage container 340, the water supply device controller 390 may sense humidity inside the vegetable storage container 340 using the humidity sensor 395.

If the humidity sensed by the humidity sensor 395 is less than a preset humidity (e.g., relative humidity of 85%), the water supply device controller 390 may supply water to inside of the vegetable storage chamber 350 by controlling the water supply device 370. Accordingly, the humidity inside the vegetable storage chamber 350 may be properly maintained. As a result, vegetables and/or fruits inside the vegetable storage chamber 350 can be prevented from being damaged due to withering.

The ozone water generator 380 may generate ozone water in the tank 372 at preset time periods. Under such configuration, pollution and decay of water supplied from the water supply device 370 can be prevented. Further, as the ozone water is sprayed into the vegetable storage chamber 350 by the spray portion 375, vegetables and/or fruits inside the vegetable storage chamber 350 can be stored for a longer period of time by a sterilization effect by the ozone water.

Hereinafter, a refrigerator according to still another embodiment of the present invention will be explained with reference to FIG. 16.

The same components as those of the aforementioned embodiment will be provided with the same reference numerals, and detailed explanations thereof will be omitted.

A refrigerator according to still another embodiment of the present invention may comprise: a refrigerator body 110 having a cooling chamber 120; a vegetable storage container 340 provided in the cooling chamber 120; a vegetable storage container blocking portion 360 provided outside the vegetable storage container 340, and forming a vegetable storage chamber 350 therein together with the vegetable storage container 340; and a water supply device 370 configured to supply water to inside of the vegetable storage chamber 350. The refrigerator body 110 may be provided with a plurality of cooling chambers 120.

The cooling chamber 120 may be provided with a freezing chamber 121 and a refrigerating chamber 122.

Figure 16:
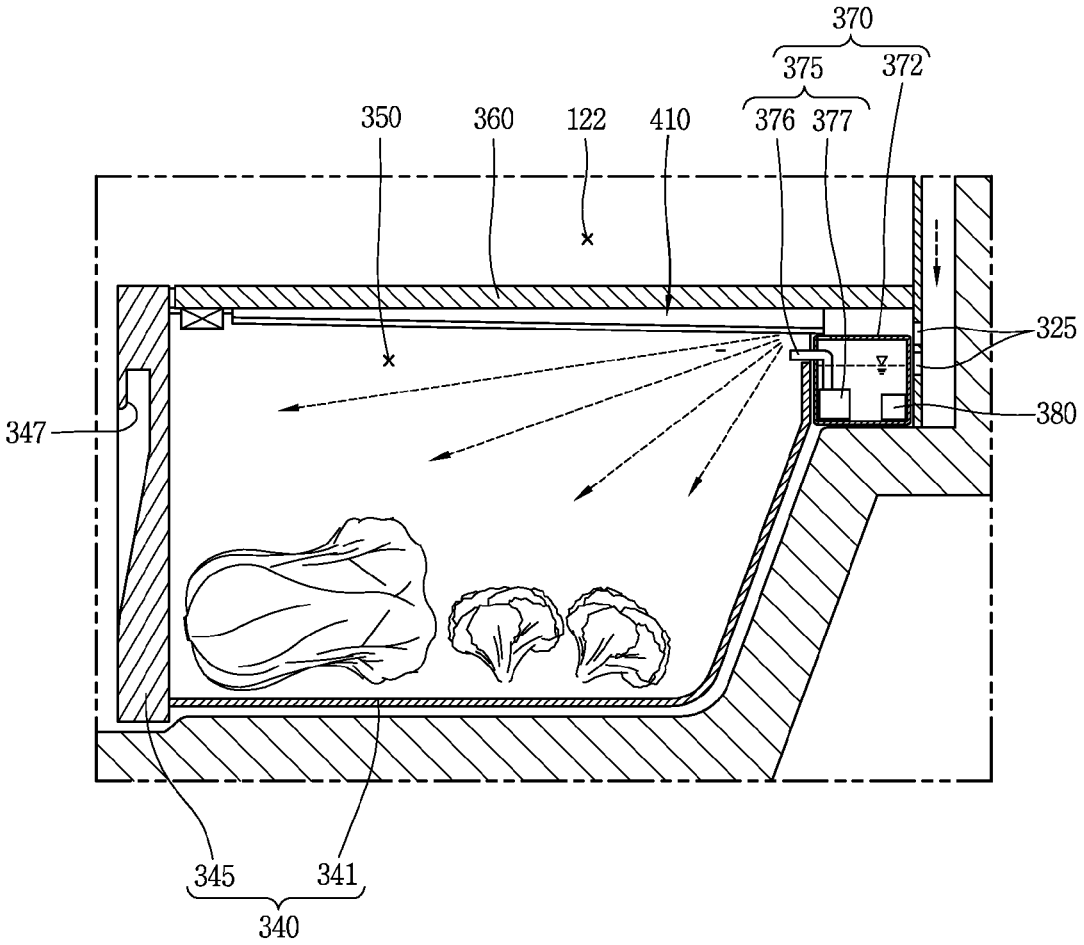
FIG. 16 is a sectional view illustrating a main part of a refrigerator according to still another embodiment of the present invention.

As shown in FIG. 16, the vegetable storage container 340 and the vegetable storage container blocking portion 360, which form the vegetable storage chamber 350 therein, may be provided in the refrigerating chamber 122.

The water supply device 370, which is configured to supply water to inside of the vegetable storage chamber 350, may be provided at a rear region of the vegetable storage container 340.

The water supply device 370 may comprise a tank 372 configured to store water therein, and a spray portion 375 configured to spray water inside the tank 372.

An ozone water generator 380, which is configured to generate ozone water, may be provided in the tank 372 of the water supply device 370.

A humidity sensor 395, which is configured to sense humidity, may be installed in the vegetable storage chamber 350.

A water collecting cover 410 may be provided in the vegetable storage chamber 350.

The water collecting cover 410 may be provided at an upper region inside the vegetable storage chamber 350, and may be configured to guide water collected as moist is condensed on the surface, to the water supply device 370.

The water collecting cover 410 may be implemented as a metallic member.

For instance, the water collecting cover 410 may be formed of stainless steel. Under such configuration, the water collecting cover 410 maintains a relative low temperature when contacting cool air discharged through the cool-air outlet 325, and has water condensation occurring on its surface, thereby easily performing water collection.

Figure 17:
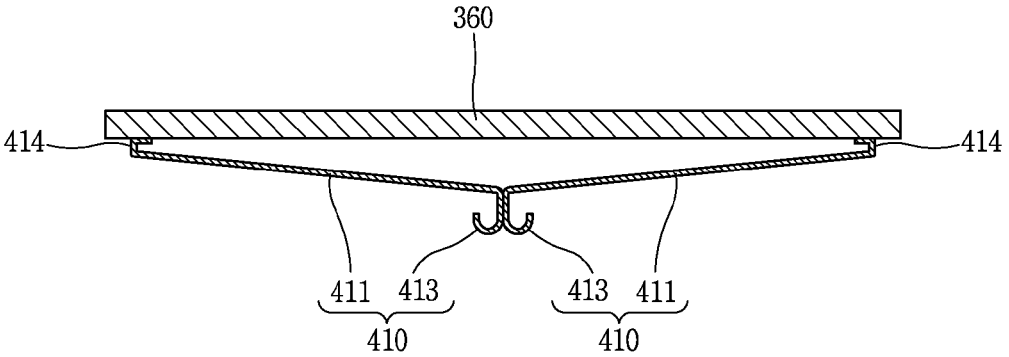
FIG. 17 is a sectional view of a water collecting cover of FIG. 16.

As shown in FIG. 17, the water collecting cover 410 may comprise a plate portion 411, and a channel portion 413 provided below the plate portion 411, and forming a moving path of water therein.

The water collecting cover 410 may be disposed below the vegetable storage container blocking portion 360.

The water collecting cover 410 may be disposed so as to be downwardly inclined toward the water supply device 370. Under such configuration, water collected in the water collecting cover 410 may be guided to the water supply device 370.

For instance, the water collecting cover 410 may be provided with two plate portions 411 and two channel portions 413.

Each plate portion 411 may be formed to be downwardly inclined toward a central region of the vegetable storage container blocking portion 360, in right and left directions of the refrigerating chamber 122.

A connection portion 214 connected to the vegetable storage container blocking portion 360 may be formed at one side of the plate portion 411.

The channel portion 413, through which water moves, may be formed at another side of the plate portion 411. The channel portion 413 may have a channel-shaped section (or U-shaped section).

Under such configuration, once vegetables and/or fruits of relatively high temperature and high humidity are accommodated in the vegetable storage chamber 350, water condensation may occur on the surface of the water collecting cover 410. The condensed water may move along the surface of the plate portion 411 to thus be collected into the channel portion 413. Then the water collected in the channel portion 413 may move to the water supply device 370.

If an inner humidity of the vegetable storage chamber 350 sensed by the humidity sensor 395 is less than a preset humidity, the water supply device controller 390 may control the water supply device 370 so that water can be supplied to the vegetable storage chamber 350.

The ozone water generator 380, which is configured to generate ozone water in the tank 372, may prevent pollution and decay of water inside the tank 372. Further, as ozone water is sprayed into the vegetable storage chamber 350, vegetables and/or fruits inside the vegetable storage chamber 350 can be stored for a longer period of time by a sterilization effect by the ozone water.

Hereinafter, a refrigerator according to still another embodiment of the present invention will be explained with reference to FIG. 18.

A refrigerator according to still another embodiment of the present invention may comprise: a refrigerator body 110 having a cooling chamber 120; a vegetable storage container 340 provided in the cooling chamber 120; a vegetable storage container blocking portion 360 provided outside the vegetable storage container 340, and forming a vegetable storage chamber 350 therein together with the vegetable storage container 340; and a water supply device 370 configured to supply water to inside of the vegetable storage chamber 350.

The refrigerator body 110 may be provided with a plurality of cooling chambers 120.

The cooling chamber 120 may be provided with a freezing chamber 121 and a refrigerating chamber 122.

Figure 18:
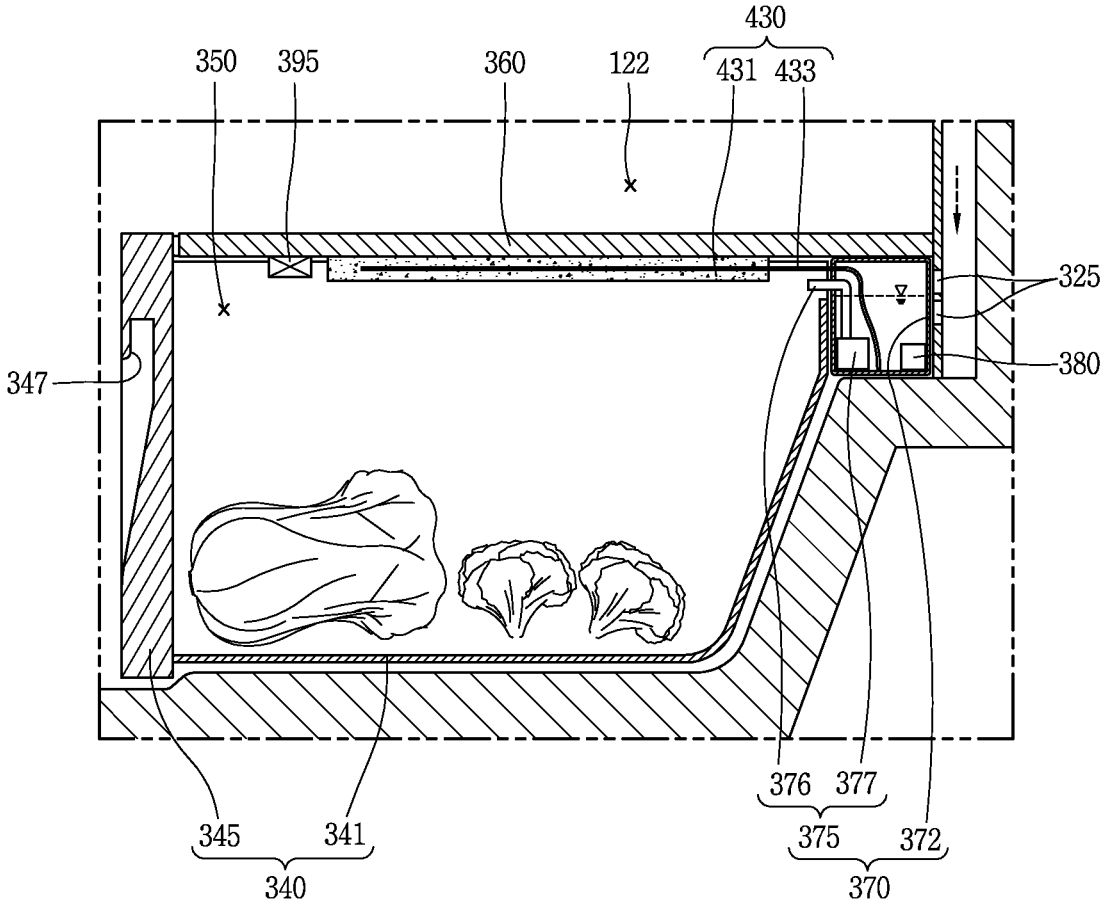
FIG. 18 is a sectional view illustrating a main part of a refrigerator according to still another embodiment of the present invention.

As shown in FIG. 18, the vegetable storage container 340 and the vegetable storage container blocking portion 360, which form the vegetable storage chamber 350 therein, may be provided in the refrigerating chamber 122.

The water supply device 370 may be provided at a rear region of the vegetable storage container 340.

A humidity sensor 395, which is configured to sense humidity, may be installed in the vegetable storage chamber 350.

A humidity adjustable element 430 may be provided in the vegetable storage chamber 350. One side of the humidity adjustable element 430 is connected to water of the water supply device 370, and another side thereof is disposed in the vegetable storage chamber 350. Under such configuration, water supplied from the water supply device 370 evaporates from inside of the vegetable storage chamber 350.

The humidity adjustable element 430 may be implemented as a porous member.

The humidity adjustable element 430 may comprise a body 430 implemented as a porous member; and a water supply member 433 having one side connected to the body 431, having another side extending to outside of the body 431 so as to be soaked in water, and configured to supply water to the body 431. The water supply member 433 may extend so as to be soaked in water supplied from the water supply device 370. For instance, the body 431 may be formed of a solid material such as diatomite in a rectangular parallelepiped shape, and the water supply member 433 may be formed of fabrics (textiles) having flexibility.

One end of the water supply member 433 may be inserted into the body 431 by a prescribed length, and another end thereof may extend toward outside of the body 431 by a prescribed length.

As the part extending toward outside of the body 431 is soaked in water stored in the tank 372, water may move to the body 431, i.e., another end of the water supply member 433, by a principle of siphon to thus evaporate. As the body 431 is provided with a large number of holes in order to increase a contact area with air, water can smoothly evaporate.

Under such configuration, water inside the vegetable storage chamber 350 continuously evaporates by the humidity adjustable element 430. As a result, a large amount of humidity can be maintained in the vegetable storage chamber 350.

If the humidity sensed by the humidity sensor 395 is less than a preset humidity, the water supply device controller 390 may supply water to inside of the vegetable storage chamber 350 by controlling the water supply device 370 (more specifically, the pump 177 of the water supply device 370).

Hereinafter, a refrigerator according to still another embodiment of the present invention will be explained with reference to FIGS. 19 and 20.

A refrigerator according to still another embodiment of the present invention may comprise: a refrigerator body 110 having a cooling chamber 120; a vegetable storage container 340 provided in the cooling chamber 120; a vegetable storage container blocking portion 360 provided outside the vegetable storage container 340, and forming a vegetable storage chamber 350 therein together with the vegetable storage container 340; and a water supply device 370 configured to supply water to inside of the vegetable storage chamber 350.

The refrigerator body 110 may be provided with a plurality of cooling chambers 120.

The cooling chamber 120 may be provided with a freezing chamber 121 and a refrigerating chamber 122.

Figure 19:
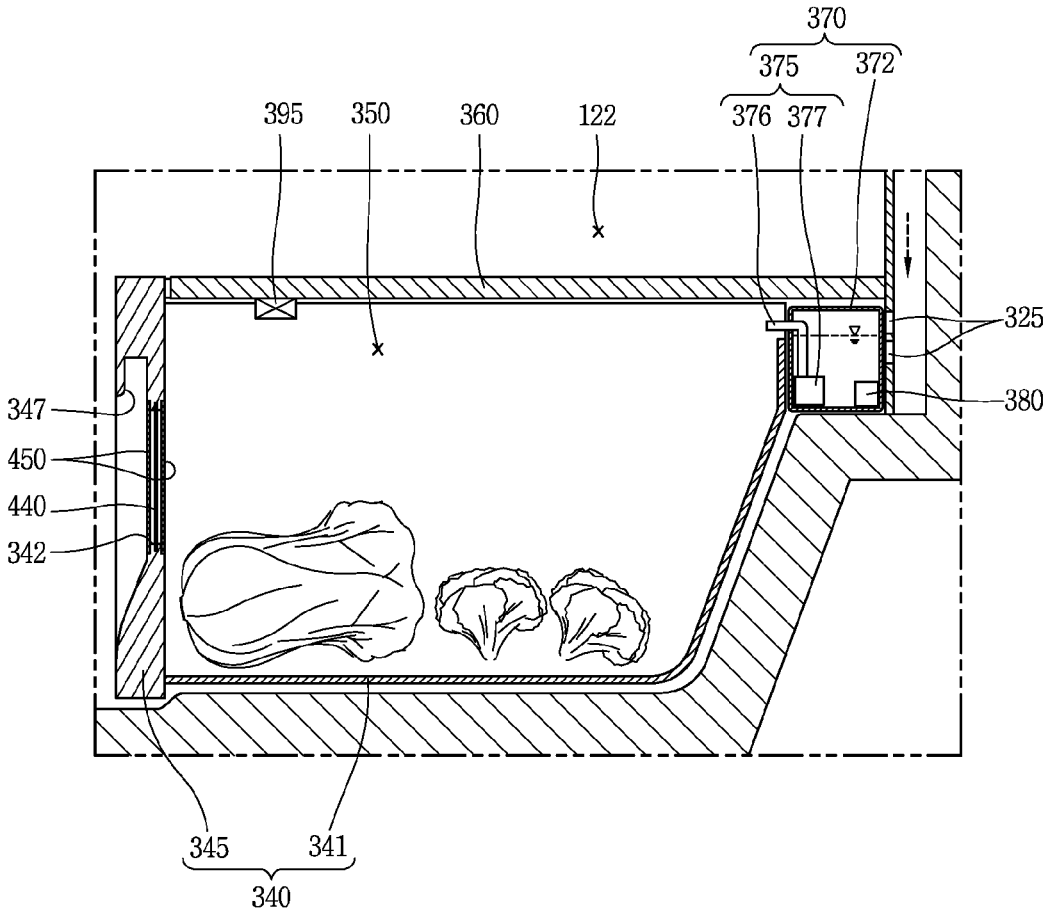
FIG. 19 is a sectional view illustrating a main part of a refrigerator according to still another embodiment of the present invention.

As shown in FIG. 19, the vegetable storage container 340 and the vegetable storage container blocking portion 360, which form the vegetable storage chamber 350 therein, may be provided in the refrigerating chamber 122. A gasket may be provided between the vegetable storage container 340 and the vegetable storage blocking portion 360, thereby sealing the vegetable storage chamber 350.

The water supply device 370 may be provided at a rear region of the vegetable storage container 340.

A humidity sensor 395, which is configured to sense humidity, may be provided in the vegetable storage chamber 350.

The vegetable storage container 340 may be provided with a through-hole 342, and a modified atmosphere film (MAF) 440 may be provided at the through-hole 342. As is well-known, the MAF 440 may be implemented as a plastic film having permeability (transmittance) with respect to gas and moist, but capable of restricting the amount of gas and moisture to be transmitted. Under such configuration, the amount of oxygen inside the vegetable storage container 340 decreases but the amount of carbonic acid gas increases, resulting in implementing a modified atmosphere (MA) condition (low oxygen and high carbonic acid gas), a preferable condition to maintain freshness of vegetables and fruits. Accordingly, the amount of respiration of vegetables and/or fruits is reduced, and thus vegetables and/or the fruits can be stored for a longer period of time.

The through-hole 342 may be provided at a front surface portion 345 of the vegetable storage container 340. In this embodiment, the through-hole 342 is formed at the front surface portion 345 of the vegetable storage container 340. However, the through-hole 342 may be formed at a side wall portion, a rear surface portion and/or a bottom surface portion of the vegetable storage container 340.

A protection member 450, which is configured to protect the MAF 440, may be provided at the through-hole 342.

For instance, the protection member 450 may be implemented as a mesh member formed as wires cross each other.

Figure 20:
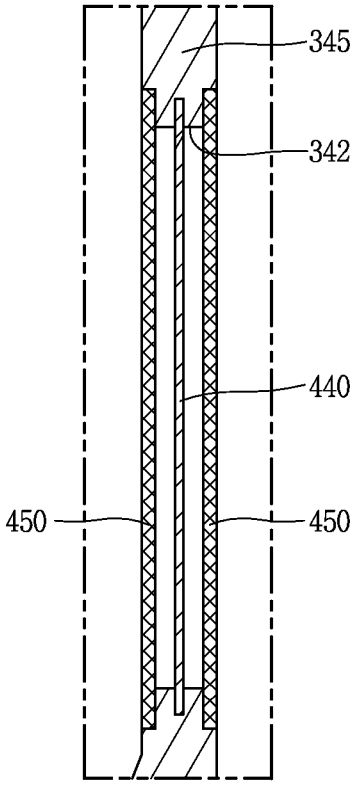
FIG. 20 is an enlarged view of a main part of a vegetable storage container of FIG. 19.

As shown in FIG. 20, the protection member 450 may be provided on at least one side of the MAF 440. In this embodiment, the protection member 450, which is implemented as a mesh member, is provided at two sides of the MAF 440. Under such configuration, inside and outside of the MAF 440 can be protected. In this embodiment, the protection member 450 and the MAF 440 are spaced from each other. However, the protection member 450 and the MAF 440 may come in contact with each other.

In this embodiment, one vegetable storage container 340 and one vegetable storage container blocking portion 360 are provided to form one vegetable storage chamber 350. However, each of the vegetable storage container 340 and the vegetable storage container blocking portion 360 may be formed in plurality, and the through-holes 342 of the plurality of vegetable storage containers 340 may be provided with MAFs (not shown) having different gas transmittances. Each vegetable storage chamber may be provided with the humidity sensor 395 and the water supply device 370. Under such configuration, vegetables and/or fruits having different respiration rates are accommodated in the respective vegetable storage chambers 350 inside the respective vegetable storage containers 340. Further, as gas transmittance (permeability) inside the accommodation spaces is properly maintained by the MAFs, a respiration rate of vegetables and/or fruits accommodated in the vegetable storage containers 340 is restricted. As a result, vegetables and/or the fruits can be stored for a longer period of time.

Under such configuration, in case of accommodating vegetables and/or fruits in the vegetable storage container 340, fruits of a relatively high respiration rate may be accommodated in a region adjacent to the through-hole 342. In the region adjacent to the through-hole 342, a state of low oxygen and high carbonic acid gas is implemented by the MAFs 440, and thus respiration of fruits is restricted. As a result, fruits can be stored for a longer period of time.

The water supply device controller 390 may control the water supply device 370 based on humidity sensed by the humidity sensor 390, so that water can be supplied to inside of the vegetable storage chamber 350.

Hereinafter, a refrigerator according to still another embodiment of the present invention will be explained with reference to FIGS. 21 to 23.

A refrigerator according to still another embodiment of the present invention may comprise: a refrigerator body 110 having a cooling chamber 120; a vegetable storage container 340 provided in the cooling chamber 120; a vegetable storage container blocking portion 360 provided outside the vegetable storage container 340, and forming a vegetable storage chamber 350 therein together with the vegetable storage container 340; and a water supply device 370 configured to supply water to inside of the vegetable storage chamber 350.

The refrigerator body 110 may be provided with a plurality of cooling chambers 120.

The cooling chamber 120 may be provided with a freezing chamber 121 and a refrigerating chamber 122.

Figure 21:
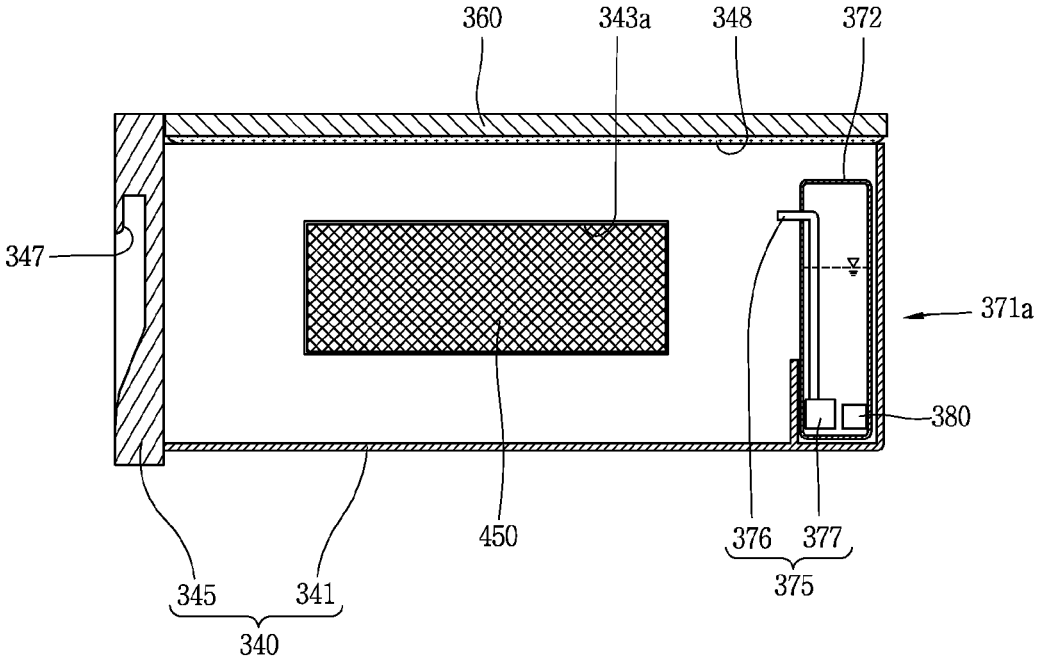
FIG. 21 is a side sectional view of a vegetable storage container of a refrigerator according to still another embodiment of the present invention.
Figure 22:
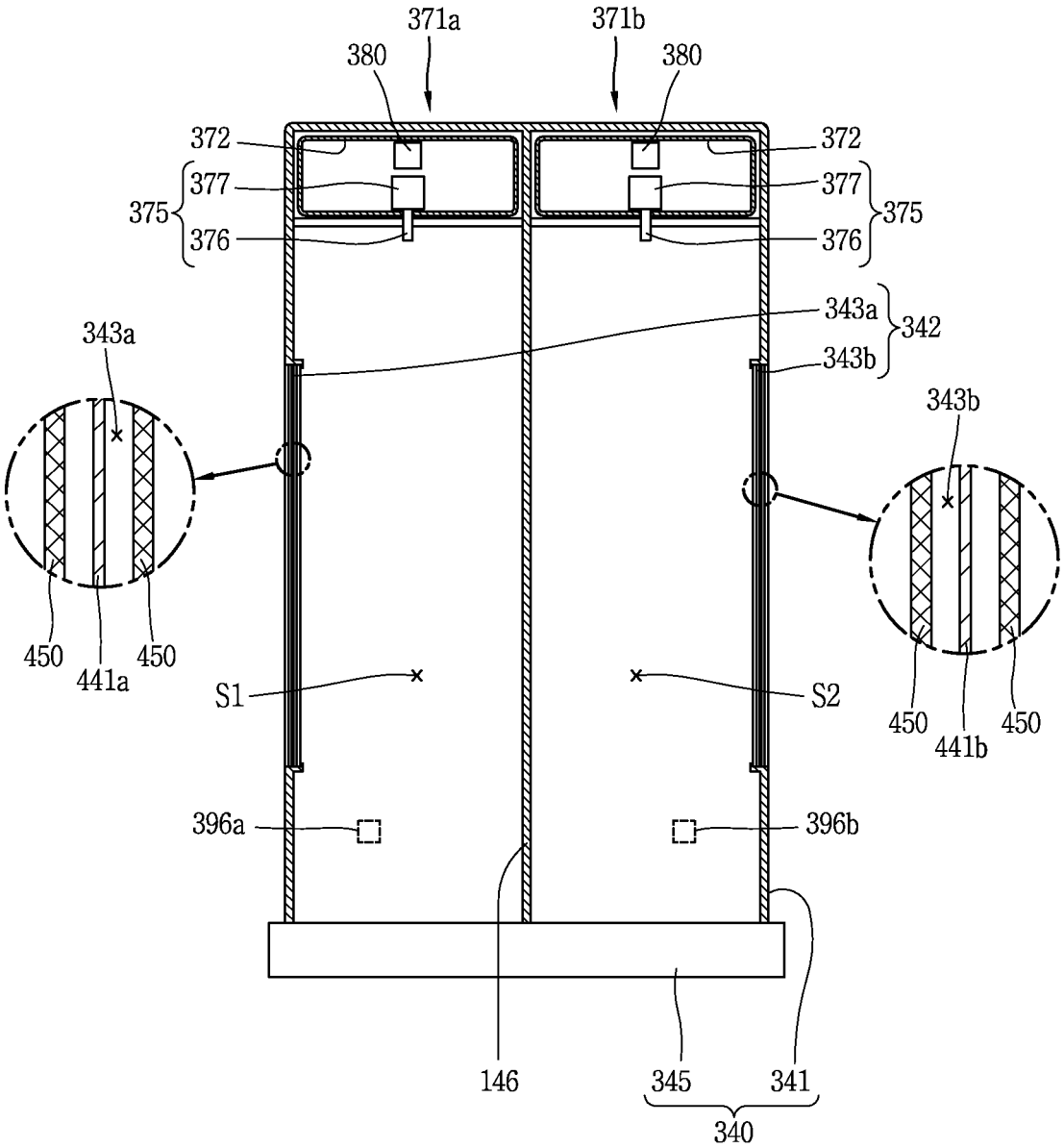
FIG. 22 is a planar sectional view illustrating an accommodated state of the vegetable storage container of FIG. 21.
Figure 23:
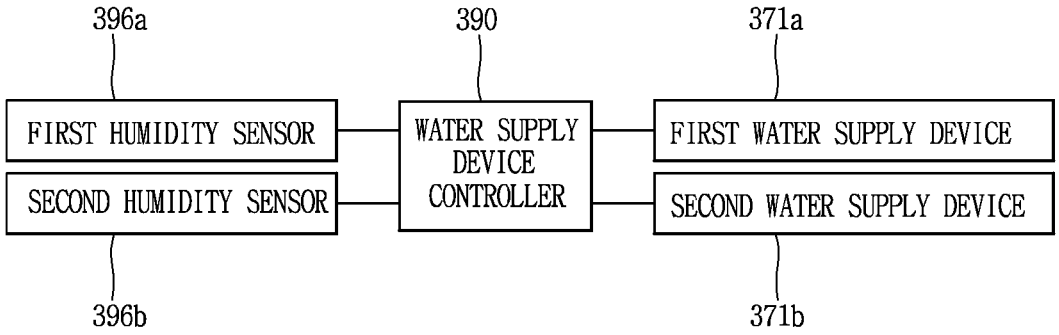
FIG. 23 is a control block diagram of the refrigerator of FIG. 21.

As shown in FIGS. 21 and 22, the vegetable storage container 340 and the vegetable storage container blocking portion 360, which form the vegetable storage chamber 350 therein, may be provided in the refrigerating chamber 122.

A gasket 348 may be provided between the vegetable storage container 340 and the vegetable storage blocking portion 360, thereby sealing inside of the vegetable storage chamber 350.

The vegetable storage container 340 may be provided with a plurality of through-holes 342.

The respective through-holes 342 may be provided with MA films having different gas transmittances.

The vegetable storage chamber 350 may be provided with a plurality of accommodation spaces having the different through-holes 342.

More specifically, a partition plate 146 may be provided in the vegetable storage container 340.

As shown in FIG. 22, the partition plate 146 may be configured to partition inside of the vegetable storage container 340 in right and left directions.

The partition plate 146 may be disposed in a lengthwise direction of the vegetable storage container 340. Under such configuration, the vegetable storage chamber 350 may be provided with a first accommodation space (s1) and a second accommodation space (s2).

The through-holes 342 may be formed at a side wall of the first accommodation space (s1) and a side wall of the second accommodation space (s2).

The through-hole 342 may be provided with a first through-hole 343*a* of the first accommodation space (s1), and a second through-hole 343*b* of the second accommodation space (s2).

The first through-hole 343*a* may be provided with a first MA film 441*a*, and the second through-hole 343*b* may be provided with a second MA film 441*b*. Here, the first MA film 441*a* and the second MA film 441*b* have different gas transmittances. Under such configuration, vegetables and/or fruits of different respiration rates may be accommodated in the first accommodation space (s1) and the second accommodation space (s2) in a separate manner. The MA films 441*a* and 441*b* having different gas transmittances maintain the amount of oxygen (or the amount of carbonic acid gas) inside the accommodation spaces (s1 and s2), so that a respiration rate of vegetables and/or fruits stored in the first accommodation space (s1) and the second accommodation space (s2) can be restricted. As a result, vegetables and/or fruits stored in the first accommodation space (s1) and the second accommodation space (s2) can be stored for a longer period of time.

A protection member 450 may be provided at each through-hole 342. This can prevent damage of the MA films 441*a* and 441*b*.

The first accommodation space (s1) may be provided with a first water supply device 371*a*, and the second accommodation space (s2) may be provided with a second water supply device 371*b*. Under such configuration, water can be supplied to the accommodation spaces (s1 and s2) in a separate manner.

The first accommodation space (s1) may be provided with a first humidity sensor 396*a*, and the second accommodation space (s2) may be provided with a second humidity sensor 396*b*.

Each of the water supply devices 371*a* and 371*b* may comprise a tank 372 configured to store water therein, and a spray portion 375 configured to spray water inside the tank 372. Each of the water supply devices 371*a* and 371*b* may be provided with an ozone water generator 380.

Under such configuration, vegetables and/or fruits of different respiration rates may be accommodated in the first accommodation space (s1) and the second accommodation space (s2) in a separate manner. Here, vegetables and/or fruits having a similar respiration rate may be stored in the same space. This can allow vegetables and fruits to be stored for a longer period of time.

The water supply device controller 390 may sense humidity inside the first accommodation space (s1) and the second accommodation space (s2), respectively. Based on the sensed humidity, the water supply device controller 390 controls the first water supply device 371*a* and the second water supply device 371*b*. As a result, the first accommodation space (s1) and the second accommodation space (s2) can maintain a proper humidity, respectively. Under such configuration, vegetables and/or fruits inside the first accommodation space (s1) and the second accommodation space (s2) can be prevented from being damaged due to withering.

Further, the vegetables and/or the fruits inside the first accommodation space (s1) and the second accommodation space (s2) can be stored for a longer period of time, by a sterilization effect using ozone water generated from the ozone water generator 380.

The refrigerator of the present invention may have the following advantages.

Firstly, in one embodiment of the present invention, the handle and the manipulation switch of the drawer are separately configured. This can facilitate withdrawal and accommodation of the drawer.

Secondly, components including the fixed arm are provided in the drawer (in the wall surface). This can prevent the occurrence of restrictions when the components operate, thereby enhancing reliability of the operation.

Thirdly, when the manipulation switch is on a releasing position, auditory information (releasing sound) indicating a vacuum-released state is generated. This can enhance a user's satisfaction degree.

Fourthly, when inside of the drawer is sealed after the drawer is accommodated in the case, a manipulating direction (pressurizing direction) of the manipulation switch is the same as a compression direction of the sealing member. This can facilitate a sealing operation.

Fifthly, as water is properly supplied to inside of the vegetable storage chamber, vegetables and fruits inside the vegetable storage chamber can be stored for a longer period of time by being prevented from withering.

Sixthly, the water collecting cover is provided in the vegetable storage chamber so as to guide water to the water supply device. This can prevent damage of vegetables and fruits due to direct contact with water.

Seventhly, as the humidity adjustable element is provided in the vegetable storage chamber, moist (water) inside the vegetable storage chamber is properly maintained. This can prevent vegetables and fruits inside the vegetable storage chamber from withering.

Eighthly, the through-hole is provided at one region of the vegetable storage container, and the MA film is provided at the through-hole. Under such configuration, the amount of oxygen (the amount of carbonic acid gas) inside the vegetable storage chamber can be controlled, and thus a respiration rate of vegetables and fruits can be restricted. As a result, vegetables and fruits can be stored for a longer period of time, because a preferable environment to maintain freshness can be implemented.

Ninthly, a plurality of accommodation spaces are provided with the through-holes, and the through-holes are provided with the MA films of different gas transmittances. Vegetables and/or fruits of different respiration rates are accommodated in the respective accommodation spaces in a separate manner. This can allow vegetables and/or fruits to be stored for a longer period of time.

Tenthly, microbes and fungi can be removed by the ozone water generator for generating ozone water. This can enhance a sanitary characteristic. Further, vegetables and/or fruits can be stored for a longer period of time, by a sterilization effect using ozone water.

The foregoing embodiments and advantages are merely exemplary and are not to be considered as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be considered broadly within its scope as defined in the appended claims, and therefore all changes and modifications that fall within the metes and bounds of the claims, or equivalents of such metes and bounds are therefore intended to be embraced by the appended claims.

What is claimed is:

1. A refrigerator, comprising:

a refrigerator body having a cooling chamber;

a case in the cooling chamber, and forming an accommodation space of which a front surface is open;

a drawer having a handle, and accommodated in the case in a withdrawable manner;

a sealing member disposed at a contact region between the case and the drawer, the sealing member made of rubber and having a closed-loop shape along an edge of a front opening of the case to seal inside of the drawer when the drawer is accommodated in the case;

a sealed state maintaining device having locking portions disposed at both sides of the front surface of the case, respectively, and having fixed arms disposed at both sides of the drawer corresponding the locking portions, respectively, a manipulation switch disposed at the drawer having a rotation shaft of the manipulation switch spaced from the handle, the manipulation switch rotatable between a sealing position and a releasing position;

power transmission portions including driving arms extending from first ends of the fixed arms, respectively, and a connection rod having a central portion connected to the manipulation switch, both ends of the connection rod connected to second ends of the driving arms, respectively, the power transmission portions transmitting a driving force of the manipulation switch to the fixed arms, respectively; and a vacuum pump provided at one side of the case and having a connection pipe connecting the vacuum pump and the case to depressurize inside of the case, wherein each of the locking portions includes a contact portion having a "U" shape and protruding from the front surface of the case, a coupling portion connected to both ends of the contact portion and coupled to the front surface of the case, and a rolling contact member disposed at the contact portion and contacting the fixed arm in a rolling manner, wherein each of the fixed arms includes a rotation shaft provided at the first end of each of the fixed arms, and a bending end bent from a second end opposite to the first end of each of the fixed arms, wherein the bending end includes: a guiding section contacting the contact portion and guiding the fixed arm to move to the sealing position;

a pressurizing section protruding toward the rotation shaft at one side of the guiding section; and a maintaining section more spaced from the rotation shaft than the pressurizing section, wherein the manipulation switch includes a plate portion having a rotation shaft of the manipulation switch, the rotation shaft of the manipulation switch spaced from the connection rod, wherein the connection rod, the driving arms and the fixed arms are rotated centering around the rotation shaft, and the pressurizing section contacts the rolling contact member to make the drawer close to the case, such that the sealing member is compressed, while the manipulation switch is rotated to the sealing position, and wherein the fixed arms are separated from the contact portions, respectively, while the manipulation switch is rotated to the releasing position.

2. The refrigerator of claim 1, wherein the locking portion protrudes from a front surface of the case, and the drawer includes an insertion hole for coupling with the locking portion.

3. The refrigerator of claim 1, wherein a manipulation switch accommodation portion to accommodate the manipulation switch is on a front surface of the drawer.

4. The refrigerator of claim 1, wherein the contact portion has a circular section, wherein the rolling contact member has a cylindrical shape and is rotatably coupled to the contact portion.

5. The refrigerator of claim 1, further comprising an auditory information generator disposed at the drawer and generating auditory information when the manipulation switch moves to the releasing position, and wherein the auditory information generator comprises:

a communication portion formed through a front surface of the drawer, and an opening/closing member provided at the communication portion to open/close the communication portion.

6. The refrigerator of claim 5, wherein the communication portion is at a rear side of the manipulation switch, and wherein the opening/closing member is between the manipulation switch and the communication portion, and wherein the manipulation switch pressurizes the opening/closing member and the opening/closing member is inserted into the communication portion to block the communication portion when the manipulation switch is in the sealing position.

7. The refrigerator of claim 6, further comprising an opening/closing member spring provided at one side of the opening/closing member and urging the opening/closing member to be separated from the communication portion.

8. The refrigerator of claim 1, further comprising:

a vegetable storage container provided in the cooling chamber and having an upper opening;

a vegetable storage container blocking portion disposed on an upper end of the vegetable storage container, and forming a vegetable storage chamber together with the vegetable storage container; and a water supply device provided at a rear side of the vegetable storage container, the water supply device supplying water into the vegetable storage container.

9. The refrigerator of claim 8, wherein the water supply device comprises:

a tank disposed at the rear side of the vegetable storage container to store water therein; and a spray portion disposed at the rear side of the vegetable storage container to spray water inside the tank into the vegetable storage container.

10. The refrigerator of claim 9, further comprising a water collecting cover outside the vegetable storage container, and configured to guide collected water to the water supply device, wherein the water collecting cover comprises:

a plate portion; and a channel portion below the plate portion, and forming a moving path of water therein.

11. The refrigerator of claim 9, further comprising a humidity adjustable element formed as a porous member, having one side connected to water supplied from the water supply device, having another side disposed in the vegetable storage chamber, and configured to evaporate water supplied from the water supply device from inside of the vegetable storage chamber.

12. The refrigerator of claim 9, wherein the water supply device has an ozone water generator disposed in the tank, the ozone water generator generating ozone water in the tank, and wherein the water supply device supplies the ozone water in the tank into the vegetable storage container.

13. The refrigerator of claim 8, wherein the vegetable storage container includes a through-hole, and a modified atmosphere film at the through-hole.

14. The refrigerator of claim 13, wherein the through-hole is formed in plurality, and MAFs having different oxygen transmittances are at the plurality of through-holes.

15. The refrigerator of claim 14, wherein the vegetable storage chamber includes a plurality of accommodation spaces partitioned from each other with the different through-holes.

16. The refrigerator of claim 14, further comprising a protection member at one side or two sides of the modified atmosphere film.

17. The refrigerator of claim 13, wherein each of the vegetable storage container and the vegetable storage container blocking portion is formed in plurality, and wherein the vegetable storage containers include modified atmosphere films having different gas transmittances.

* * * * *